United States Patent [19]

Allen

[11] Patent Number: 4,741,643

[45] **Date of Patent: * May 3, 1988**

[54] LATERALLY TRANSLATABLE, CARRIAGE-MOUNTED, CONCRETE FINISHING APPARATUS

[75] Inventor: J. Dewayne Allen, Paragould, Ark.

[73] Assignee: Allen Engineering Corporation, Euless, Tex.

[ * ] Notice: The portion of the term of this patent subsequent to Aug. 21, 2001 has been disclaimed.

[21] Appl. No.: 946,422

[22] Filed: Dec. 24, 1986

Related U.S. Application Data

[63] Continuation-in-part of Ser. No. 704,339, Feb. 22, 1985, Pat. No. 4,648,741, which is a continuation-in-part of Ser. No. 632,398, Jul. 19, 1984, abandoned, which is a continuation of Ser. No. 598,662, Apr. 10, 1984, abandoned, which is a continuation of Ser. No. 457,727, Jan. 13, 1983, Pat. No. 4,466,757.

[51] Int. Cl.[4] ..... E01C 19/30

[52] U.S. Cl. ..... 404/114; 404/119

[58] Field of Search ..... 404/96, 101, 102, 105, 404/106, 113–115, 118–120; 425/62, 63, 425, 426, 429, 432, 456

[56] References Cited

U.S. PATENT DOCUMENTS

| | | | |
|---|---|---|---|
| 1,840,970 | 1/1932 | Noble | 404/102 |
| 2,006,316 | 6/1935 | Mondt | 404/101 |
| 2,038,416 | 4/1936 | Clifford | 404/114 |
| 2,094,910 | 10/1937 | Baily | 404/96 |
| 2,248,247 | 7/1941 | Nichols | 404/120 |
| 2,346,379 | 4/1944 | Jackson | 404/102 |
| 2,380,435 | 7/1945 | Heltzel | 404/102 |
| 2,439,620 | 4/1948 | Faber | 404/101 |
| 2,473,961 | 6/1949 | Mandt et al. | 404/118 |
| 2,583,108 | 1/1952 | Lewis | 404/101 |
| 2,746,366 | 5/1956 | Reed | 404/120 |
| 2,757,588 | 8/1956 | Pollitz | 404/114 |
| 3,009,400 | 11/1961 | Gerber et al. | 404/119 |
| 3,110,234 | 11/1963 | Oster | 404/119 |
| 3,113,494 | 12/1963 | Barnes | 404/114 |
| 3,262,378 | 7/1966 | Schrimper et al. | 404/120 |
| 3,321,250 | 5/1967 | Truelock | 299/39 |
| 3,377,933 | 4/1968 | Dale | 404/98 |
| 3,528,348 | 9/1970 | Rowe et al. | 404/120 |
| 3,540,360 | 11/1970 | Snow, Jr. et al. | 404/120 |
| 3,555,983 | 1/1971 | Swisher, Jr. et al. | 404/114 |
| 3,883,259 | 5/1975 | Berg et al. | 404/120 |
| 4,068,970 | 1/1978 | Rowe | 404/101 X |
| 4,213,749 | 7/1980 | Morrison | 404/120 X |
| 4,253,778 | 3/1981 | Morrison | 404/114 |
| 4,320,987 | 3/1982 | Rowe et al. | 404/115 |
| 4,335,976 | 6/1982 | Morrison | 404/114 |
| 4,375,351 | 3/1983 | Allen | 404/114 X |
| 4,466,757 | 8/1984 | Allen | 404/119 X |
| 4,484,834 | 11/1984 | Rowe et al. | 404/119 X |
| 4,572,704 | 2/1986 | Allen | 404/119 X |
| 4,648,741 | 3/1987 | Allen | 404/114 X |

OTHER PUBLICATIONS

"Spring, 1982 CMI Corporation News" brochure (Special Bid-Well Issue).

"Bid-Well Concrete Finishers—Bridge Decks-Slopes-Slabs", Bottom of page: Look to the Leader.

"M—9000 Multi-Directional Slipform Paver", brochure—Another Performance, by Miller Formless Systems & Miller Formless Introduces M1000.

*Primary Examiner*—Stephen J. Novosad

*Assistant Examiner*—John F. Letchford

*Attorney, Agent, or Firm*—Cahill, Sutton & Thomas

[57] ABSTRACT

A concrete finishing apparatus includes a supporting frame having first and second spaced apart end sections engaging first and second guide tracks for advancing the apparatus along the length of an area of plastic concrete. A support element extends between the first and second end sections and includes vertically extending front and rear surfaces and an upper surface interconnecting the front and rear surfaces. A carriage is laterally translatable along the length of the support element and includes front and rear legs which straddle the support element. The carriage includes a concrete finishing device which is coupled to the front leg of the carriage for engaging and finishing the plastic concrete in front of the support element. A power source is coupled to the rear leg of the carriage and is interconnected with the concrete finishing device to energize the concrete finishing device. A carriage suspension assembly movably supports the carriage on the support element and enables the carriage to be laterally translated back and forth along the length of the support member. A carriage drive system is coupled to the supporting frame and to the carriage to translate the carriage back and forth along the length of the support member.

28 Claims, 15 Drawing Sheets

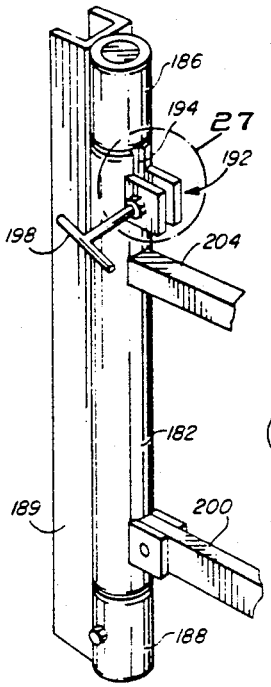
FIG. 26
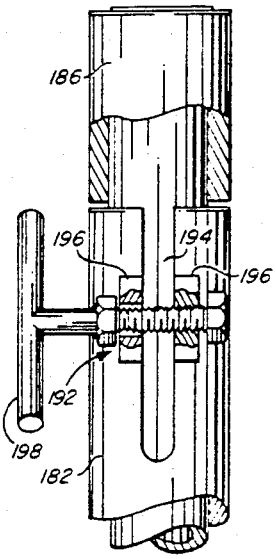
FIG. 27
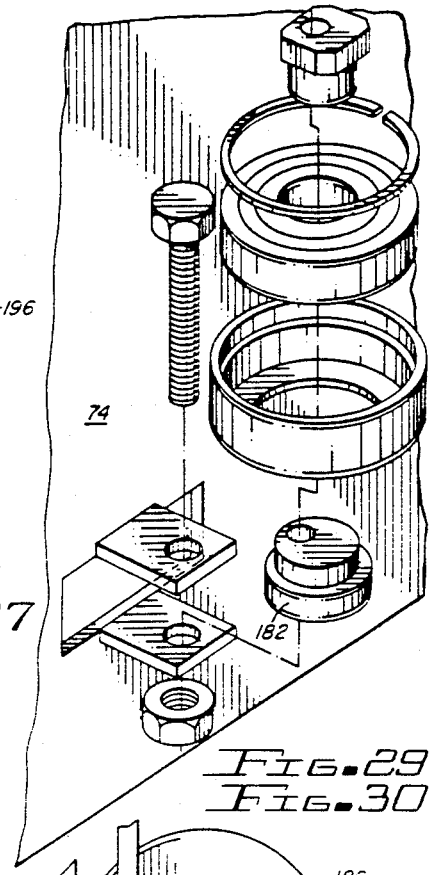
FIG. 29
FIG. 30
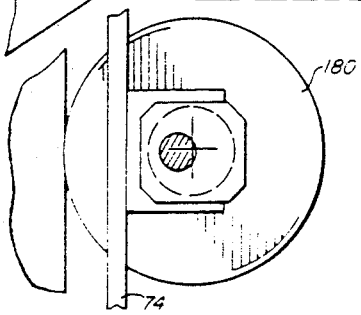
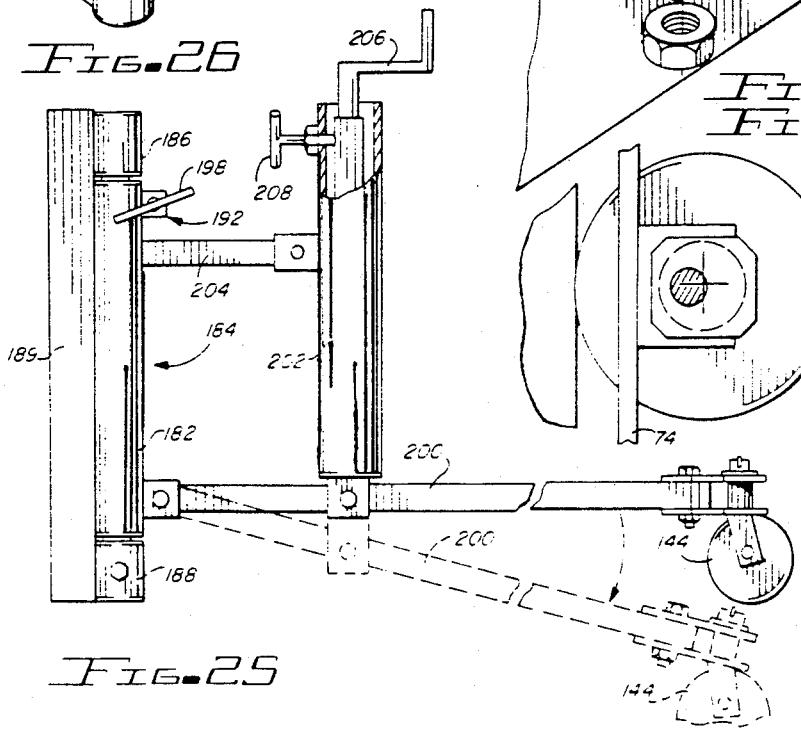
FIG. 25

LATERALLY TRANSLATABLE, CARRIAGE-MOUNTED, CONCRETE FINISHING APPARATUS

BACKGROUND OF THE INVENTION

1. Field of the Invention

This is a Continuation-in-Part application of U.S. patent application Ser. No. 704,339, filed Feb. 22, 1985 now U.S. Pat. No. 4,648,741 which is a Continuation-in-Part application of U.S. patent application Ser. No. 632,398, filed July 19, 1984 (now abandoned), which is a Continuation application of U.S. patent application Ser. No. 598,662, filed Apr. 10, 1984 (now abandoned) which is a Continuation patent application of Ser. No. 457,727, filed on Jan. 13, 1983, now U.S. Pat. No. 4,466,757, all of which are hereby incorporated by reference.

This invention relates to concrete finishing apparatus, and more particularly, to concrete finishing apparatus suspended from a laterally translatable carriage having first and second legs straddling a laterally extending carriage support element to level, laterally redistribute and finish plastic concrete.

2. Description of the Prior Art

The relevant prior art is identified in U.S. Pat. No. 4,466,757, issued on Aug. 21, 1984, the disclosure of which is hereby incorporated by reference.

SUMMARY OF THE INVENTION

It is therefore a major object of the present invention to provide a concrete finishing apparatus including a laterally translatable carriage with first and second legs straddling a laterally extending support element where a concrete finishing system is coupled to the first carriage leg and a power source for energizing the concrete finishing system and carriage drive means is coupled to the second carriage leg.

Another object of the present invention is to provide a concrete finishing apparatus including a laterally translatable carriage which includes concrete finishing means positioned in front of a supporting frame and powe means for energizing the concrete finishing means positioned behind the supporting frame.

Another object of the present invention is to provide a concrete finishing apparatus where the center of gravity of both the concrete finishing means and the power means for energizing the concrete finishing means is located below the upper surface of the carriage supporting frame.

Another object of the present invention is to provide a concrete finishing apparatus having carriage means laterally translatable along a supporting frame including rotating auger concrete finishing means for levelling, redistributing and partially finishing plastic concrete before engagement by a front screed blade.

Another object of the present invention is to provide a concrete finishing apparatus having spaced apart, variable speed vibration means separately coupled to front and rear concrete finishing blades for permitting independent control of the amplitude and frequency of vibration imparted to the front and rear finising blades and to the underlying plastic concrete.

Another object of the present invention is to provide a concrete finishing apparatus having laterally translatable carriage means for supporting and translating concrete finishing means in the form of dual, counter-rotating augers for levelling, redistributing and partially finishing plastic concrete before engagement by a front concrete finishing blade.

Another object of the present invention is to provide a concrete finishing apparatus supported by two spaced apart end sections having independently controllable height and tilt adjustments.

Briefly stated, and in accord with one embodiment of the invention, a concrete finishing apparatus finishes the irregular surface of an area of plastic concrete lying between first and second laterally spaced apart guide tracks. A supporting frame includes first and second laterally spaced apart end sections which engage the first and second guide tracks and advance the apparatus along the length of the area of concrete. The supporting frame includes a support element which extends between the first and second end sections and includes vertically extending front and rear surfaces and an upper surface which interconnects the front and rear surfaces. Carriage means is laterally translatable along the length of the support element and includes front and rear legs which straddle the support element. The carriage means includes concrete finishing means, power means, carriage suspension means and carriage drive means. The concrete finishing means is coupled to the front leg of the carriage means and engages and finishes the plastic concrete in front of the support element. The power means is coupled to the rear leg of the carriage means and is interconnected with the concrete finishing means by power transmission means to energize the concrete finishing means. The carriage suspension means movably supports the carriage means on the support element and enables the carriage means to be laterally translated back and forth along the length of the support element. The carriage drive means is coupled to the support element and to the carriage means and translates the carriage means back and forth along the support element.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

FIG. 25 is a partially cutaway elevational view of the end support structure of the screed depicted in FIG. 24, particularly illustrating the manner in which the screed guide unit can be vertically adjusted.

FIG. 26 is an enlarged, partially cutaway perspective view of the end support member hinge structure depicted in FIG. 25.

FIG. 27 is a partially cutaway, enlarged view of the hinge clamp depicted in FIG. 26.

FIG. 29 is an exploded perspective view of the lateral adjustment device for the horizontally oriented roller depicted in FIG. 28.

FIG. 30 is a simplified view from above of the horizontally oriented support structure depicted in FIG. 28.

DESCRIPTION OF THE PREFERRED EMBODIMENT

In order to better illustrate the advantages of the invention and its contributions to the art, a preferred hardware embodiment of the invention will now be described in some detail.

Figure 1:
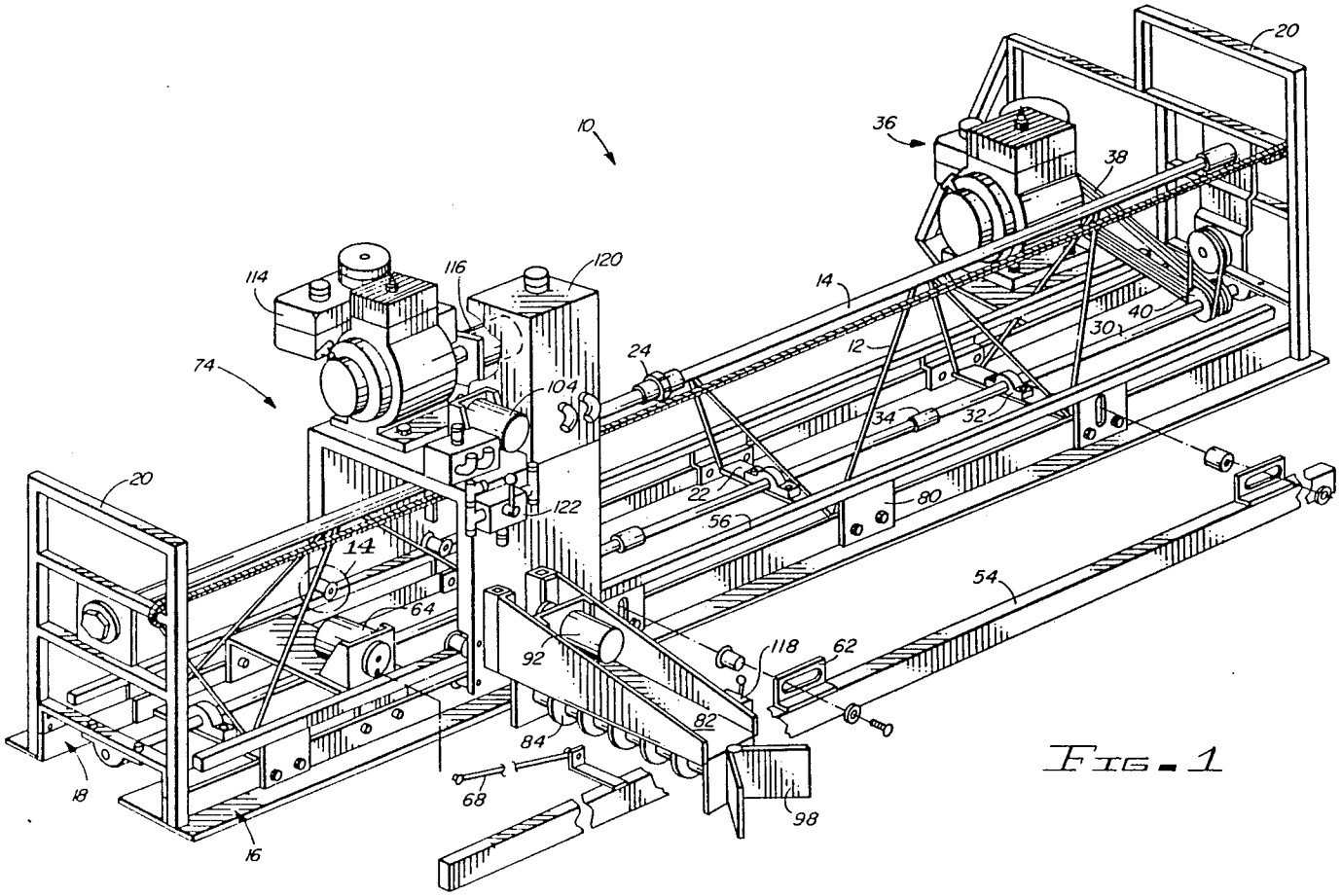
FIG. 1 is a partial perspective view of the primary structural elements of the vibratory concrete screed of the present invention. For the purpose of clarity, several subsidiary structures of the screed are not depicted in FIG. 1.
Figure 2:
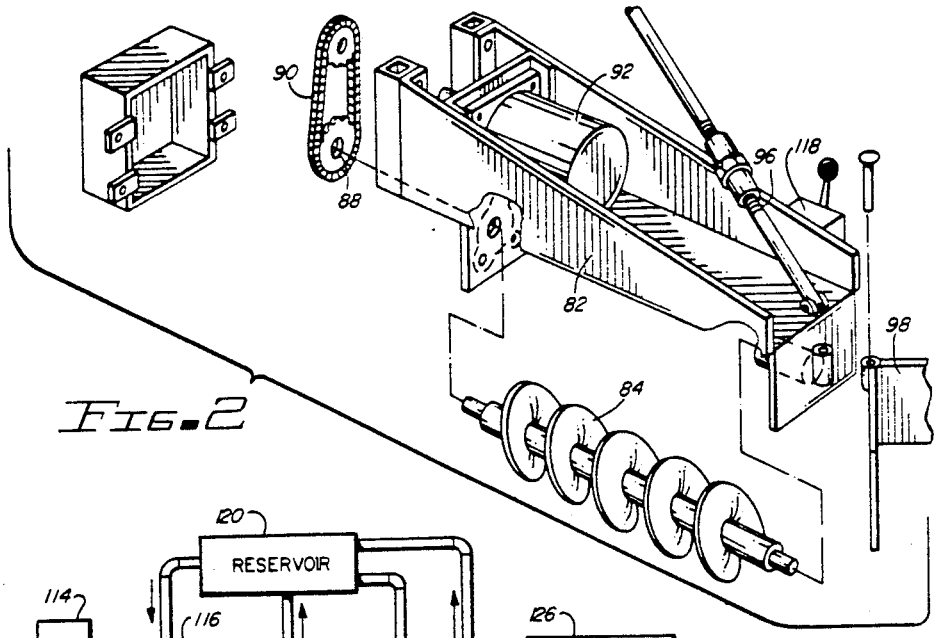
FIG. 2 is an exploded perspective view of the primary elements of the auger and auger drive assembly.
Figure 11:
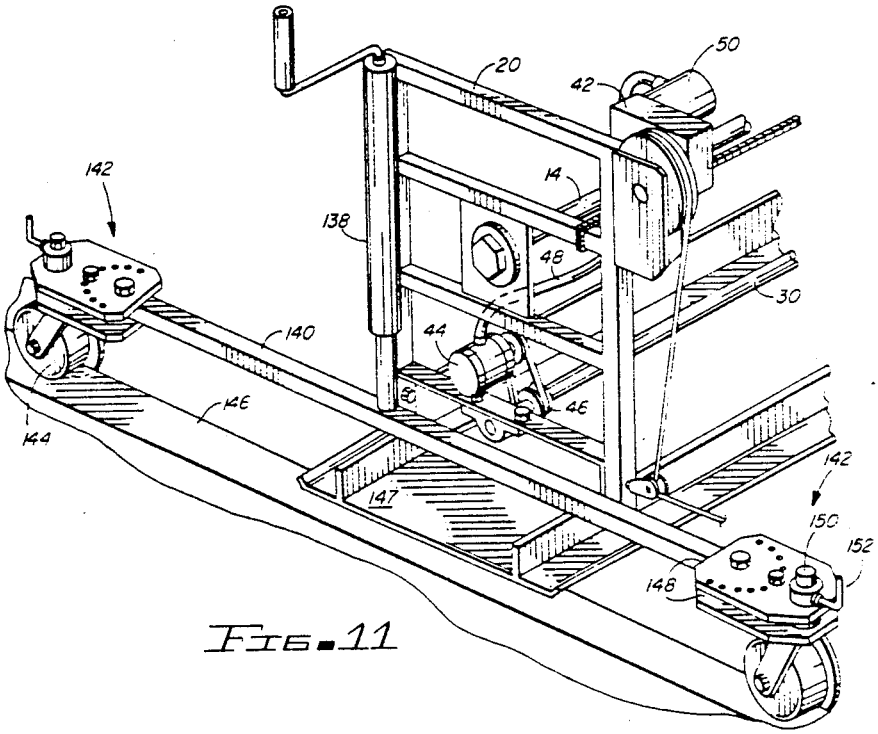
FIG. 11 is an enlarged perspective view of one end of the vibratory concrete screed of the present invention, particularly illustrating the winch and its hydraulic power system and the screed guide means.

Referring to FIGS. 1, 2 and 11, the major operative elements of the invention will initially be discussed. Concrete screed 10 includes a triangular truss frame fabricated from a plurality of metal struts 12, a horizontally oriented top pipe 14 and front and rear screed blades 16 and 18. A vertically oriented end bracket 20 includes front and rear legs which are bolted respectively to front screed blade 16 and rear screed blade 18 and a center bracket section which is secured to an end of top pipe 14. A plurality of horizontally oriented lower frame elements, such as frame element 22, are oriented perpendicular to and span the distance between the front and rear screed blades 16 and 18. A screed truss design of this type is well known to one of ordinary skill in the art. A triangular truss screed is typically fabricated by joining together a plurality of screed frame sections and blade sections to produce a screed having the desired total length for a particular application.

Figure 10:
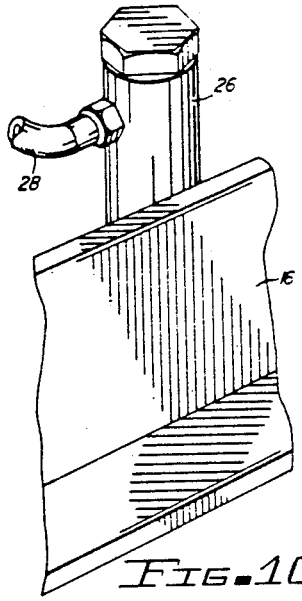
FIG. 10 illustrates the utilization of a pneumatically powered vibrator for imparting vibratory motion to the screed blades.

A top pipe coupler unit 24 joins together adjacent screed frame sections. Adjustment of this turnbuckle-like device bows the screed frame and blades to permit the contour imparted to the upper surface of the plastic concrete to be controlled to produce crowned, inverted or other desirable surface contours. In the embodiment of the present invention in which a pneumatic vibrator 26 of the type depicted in FIG. 10 is utilized, top pipe 14 also serves as a sealed conduit to distribute pressurized air along the length of the screed. A plurality of air hoses, such as air hose 28, are coupled at one end to each pneumatic vibrator 26 and at the other end to top pipe 14. Highly efficient and durable pneumatically powered vibrators of an appropriate type are commercially available from the Allen Engineering Corporation of Paragould, Ark. Top pipe 14 may also provide a source of pressurized air for actuating pneumatically powered winches which may be coupled to end brackets 20.

In the engine driven embodiment of the invention illustrated in FIG. 1, a drive shaft 30 extends along the entire length of screed 10 and is rotatably coupled to a plurality of frame elements 22 by a series of spaced apart bearing blocks, such as bearing block 32. Eccentric weights, such as eccentric weight 34, are coupled at spaced apart intervals to drive shaft 30 such that high speed rotation of drive shaft 30 causes a comparatively high frequency, controlled vibration to be transmitted to screed blade assemblies 16 and 18. In the embodiment depicted in FIG. 1, a gasoline engine 36 is coupled to a plurality of "V"-belts 38 and to a corresponding series of drive pulleys 40 to rotate drive shaft 30. In the preferred embodiment of the invention, an eight horsepower Briggs and Stratton engine is used.

Figure 16:
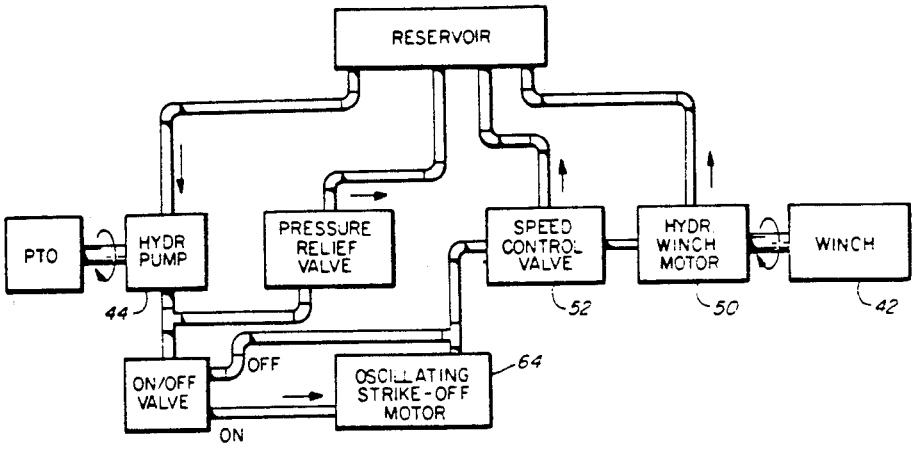
FIG. 16 is a schematic diagram representation of the self-contained hydraulic system of the oscillating strike-off attachment.

Referring now to FIGS. 1 and 11, a hydraulically powered winch embodiment of the screed translation means will be described in detail. The power take-off system for driving a hydraulic pump 44 includes a pulley 46 which is coupled to shaft 30. A "V"-belt and pulley couples the rotary motion of pulley 46 to hydraulic pump 44. The pressurized hydraulic fluid produced by hydraulic pump 44 is coupled by hose 40 to a hydraulic motor 50 which powers winch 42. FIG. 16 schematically depicts the various elements of the hydraulic winch system described above. Although not specifically illustrated in FIG. 11, a speed control valve 52 controls the volume of of pressurized hydraulic fluid through winch motor 50 to thereby control the translation velocity imparted to one end of the concrete screed by winch 42. A substantially identical independently powered hydraulic system is coupled to the opposite end of screed 10 in order to translate that end at a desired speed.

Although the hydraulically powered translation system discussed above in connection with FIG. 11 incorporates two separate hydraulic systems, a single hydraulic pump 44 could be coupled to screed end bracket 20 opposite to the end bracket to which hydraulic pump 44 is coupled. A separate speed control valve 52 for each winch hydraulic motor 50 could be coupled to a single end bracket 20 to permit one operator to independently control the translation speed of each end of the screed from a single location. Alternatively, the second speed control valve 52 could be coupled to the opposite end bracket 20 to permit a second operator to control the translation velocity of the second end. Any one of the various alternatives discussed above could be readily implemented on the present invention by one of ordinary skill in the art.

Figure 13:
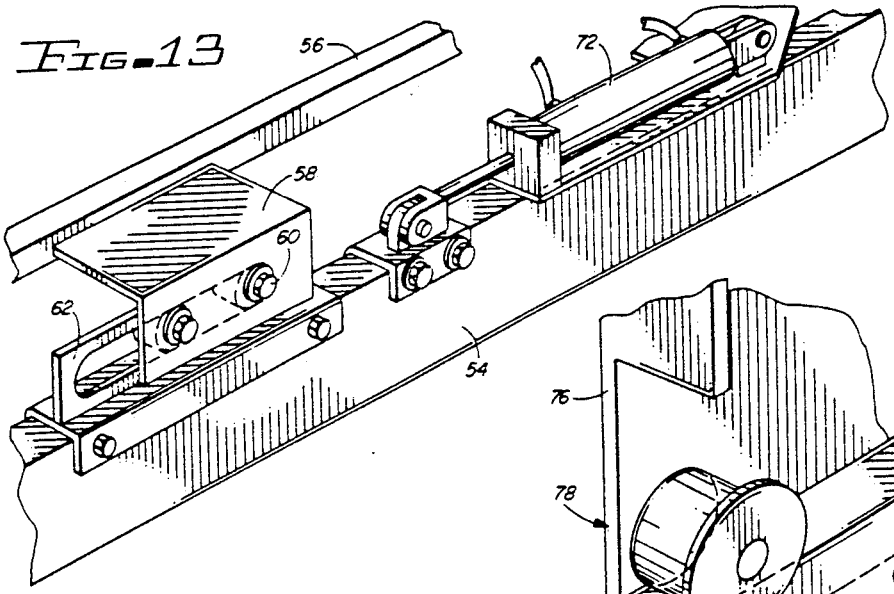
FIG. 13 is a partially cutaway perspective view of a pneumatically powered version of the oscillating strike-off attachment for the vibratory concrete screed of the present invention.

Referring now to FIGS. 1 and 13, an oscillating strikeoff attachment 54 can readily be coupled to the screed frame of the present invention. The oscillating strikeoff is reciprocated in the horizontal plane over a distance of approximately four to six inches for the purpose of smoothing and consolidating the plastic concrete before engagement by the front screed blade 16. In order to accomodate the oscillating strikeoff 54, the forward extending "L"-shaped half of front screed blade assembly 16 must be removed, leaving the rear blade element of front screed blade assembly 16 to accomplish the intial screeding operation on the surface of the plastic concrete. FIG. 13 best illustrates the manner in which oscillating strikeoff 54 is coupled to horizontally oriented track 56 by a pair of "L"-shaped brackets 58. A pair of spaced apart bolt and ball bearing support elements 60 permit reciprocating translation of oscillating strikeoff 54 with respect to bracket 58. Both FIGS. 1 and 13 depict the manner in which a vertically oriented bracket 62 is coupled to the upper surface of oscillating strikeoff 54 and includes an elongated aperture which engages support element 60.

Figure 4:
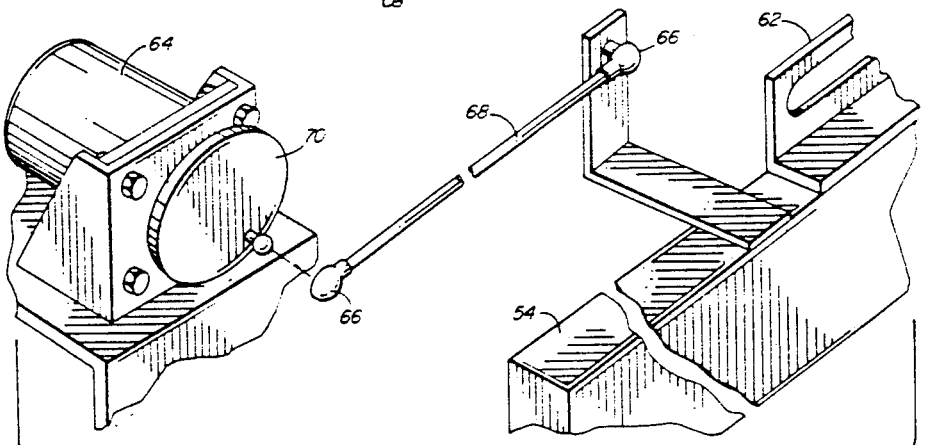
FIG. 4 is a partial perspective view showing the manner in which a hydraulic motor is coupled to the oscillating strikeoff attachment of the present invention to reciprocate the oscillating strikeoff.

In the vibratory screed depicted in FIGS. 1 and 4, strikeoff 54 is driven by a hydraulic motor 64. A ball and socket coupling unit 66 is positioned at each end of connecting rod 68 and serves to convert the rotating motion of output pulley 70 of hydraulic motor 60 into reciprocating motion of oscillating strikeoff 54. The hydraulic system diagram depicted in FIG. 16 illustrates the manner in which oscillating strikeoff motor 64 is coupled to a nearby hydraulic pump 44 which also powers a winch 50.

FIG. 13 illustrates a slightly different embodiment of oscillating strikeoff 54 which may be incorporated on a pneumatically powered vibratory screed. In this embodiment, a dual action pneumatic cylinder 72 alternatively extends and retracts its output shaft to impart the desired reciprocating motion to strikeoff 54. A pair of limit switches (not shown) change the air flow to pneumatic cylinder 72 when strikeoff 54 has been displaced to the desired maximum and minimum extension points.

Figure 14:
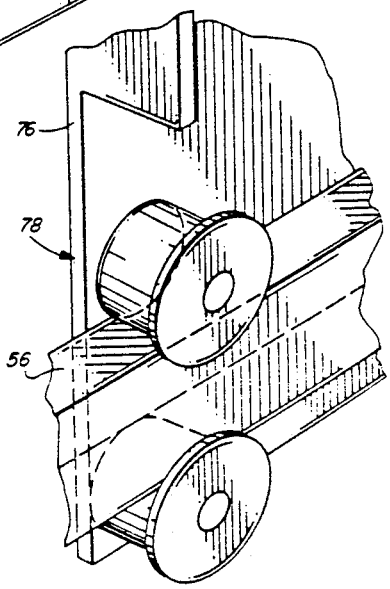
FIG. 14 is a partially cutaway perspective view particularly illustrating the manner in which the carriage is coupled to the screed frame.
Figure 17:
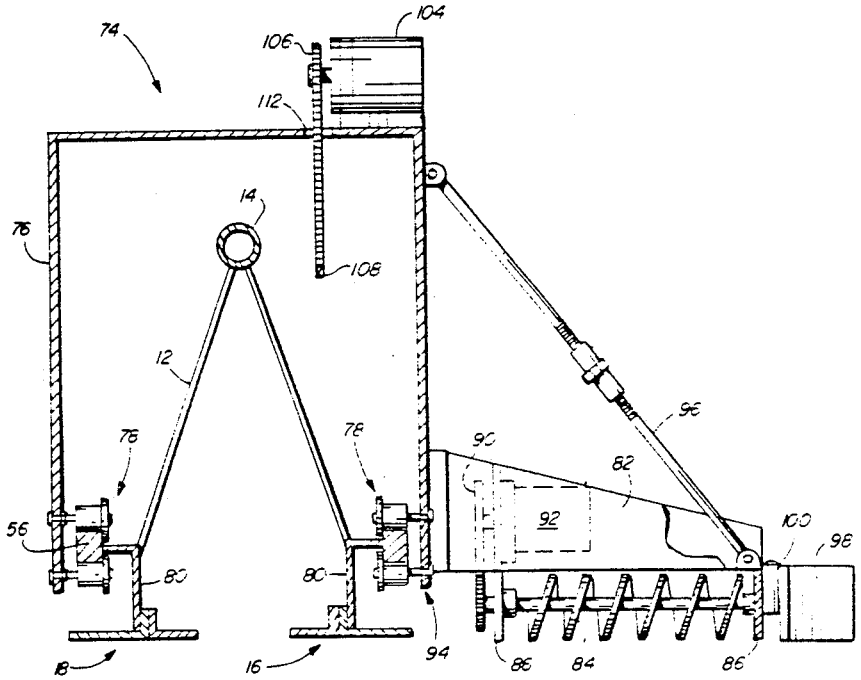
FIG. 17 is a partially cutaway sectional view of the vibratory concrete screed of the present invention.

Referring now to FIGS. 1, 2 and 17, the concrete spreading means or device for the concrete screed will now be described in detail. The primary structural element of concrete spreading device 74 comprises an inverted "U"-shaped steel bracket 76 which forms a part of the carriage means of the present invention. A plurality of four paired roller assemblies are coupled to the lower left and right ends of the front and rear sides of bracket 76. The roller elements of roller assemblies 78 surround and engage a horizontally oriented track 56 which is coupled to and supported above front and rear screed assemblies 16 and 18 by a plurality of vertically oriented supports 80. The spacing between the upper and lower rollers of roller assembly 78 is such that only either the upper roller assembly or the lower roller assembly contacts track 56. The lower roller elements of roller assemblies are provided to prevent bracket 76 from tilting away from track 56 as a result of a load or force imbalance. FIG. 14 depicts a substantially enlarged view of a single roller assembly 78.

Grading means in the form of either an auger or a grading blade or both an auger and a grading blade is coupled to and laterally translated by the carriage means. An embodiment of the grading means which includes both an auger and a grading blade will now be described in detail.

An auger support bracket 82 extends laterally out from the lower, front side of carriage means bracket 76. A horizontally oriented auger 84 is rotatably coupled to bracket 82 by vertically oriented auger mounting brackets 86. A sprocket wheel 88 is coupled to the protruding end of the shaft of auger 84 and engages a drive chain 90 which is coupled to and rotated by a hydraulic motor 92. The FIG. 3 schematic diagram of the concrete spreading device illustrates that hydraulic fluid flows in a single direction and at a constant rate through auger motor 92. The rotating auger engages the irregular upper surface of the plastic concrete, distributes and levels the concrete and displaces excess concrete forward and away from front screed blade assembly 16.

In the preferred embodiment of the invention, auger support bracket 82 is coupled only at its lower interior surface to the lower front surface of bracket 76 at approximately the point indicated by reference number 94. A turnbuckle assembly 96 is coupled at one end to the upper central surface of bracket 76 and at the opposite end to the outermost extension of auger support bracket 8. Turnbuckle assembly 96 permits the elevation of the outermost portion of auger 84 to be adjusted with respect to the elevation of front screed blade assembly 16. It has been found that for plastic concrete having a typical slump that the outer end of auger 84 should be adjusted to an elevation of approximately $\frac{1}{4}$ inch below the lower surface of front screed blade assembly 16. For unusually stiff, low slump concrete, the elevation of the outer end of auger 84 may be adjusted to be approximately equal to the elevation of the lower surface of front screed blade assembly 16. In a less complex embodiment of the present invention, turnbuckle assembly 96 may be eliminated and the innermost surface of auger support bracket 82 rigidly coupled to bracket 76.

Figure 15A:
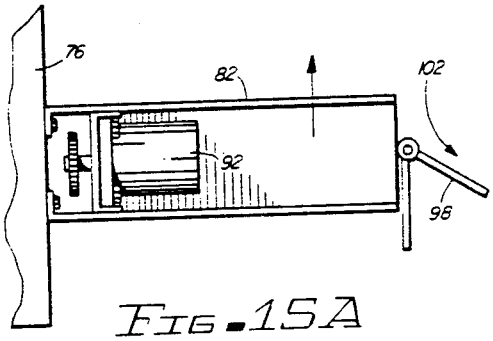
FIGS. 15A and B are partially cutaway plan views of the carriage depicting the manner in which the concrete grading blade is repositioned between the first and second trailing positions as a result of reversal of the direction of travel of the concrete spreading device.
Figure 15B:
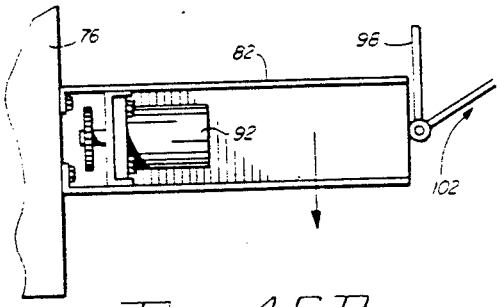

A pivoting grading blade or plow 98 is coupled by a vertically oriented hinge 100 to the outer end of auger support bracket 82. As indicated in FIGS. 15A and B, grading blade 98 reverses direction as a function of the direction of travel of concrete spreading device 75. Arrows 102 in FIG. 15 illustrate the manner in which excess plastic concrete is deflected or displaced away from the concrete screed as a result of the operation of gradient blade 98. Grading blade 98 partially levels the irregular upper surface of the plastic concrete and assists in laterally distributing the excess concrete to produce a more nearly level surface before engagement by auger 84.

Although grading blade 98 may be eliminated from certain embodiments of the present invention, substantially increased speed, efficiency and improved operation of the present invention is realized if a grading blade is utilized.

Figure 5:
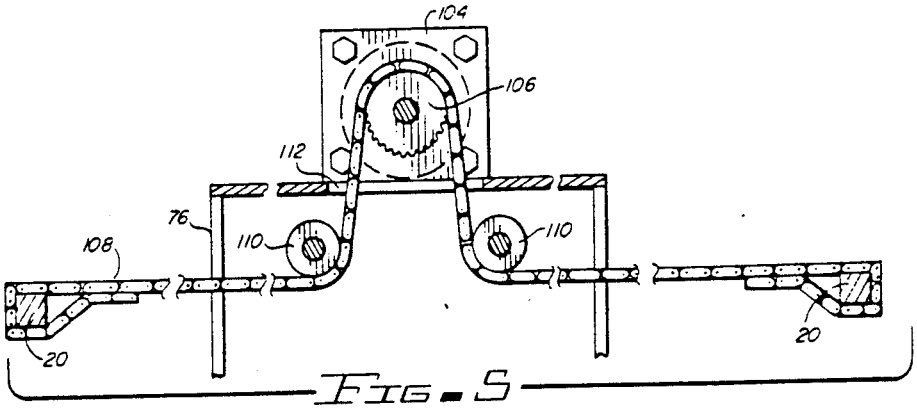
FIG. 5 is a paritally cutaway, elevational view indicating the manner in which the hydraulic drive motor for the carriage is coupled to the frame of the concrete screed.

FIGS. 5 and 17 best illustrate the components which translate the concrete spreading device 74 back and forth along the length of concrete screed 10. A hydraulic motor 104 rotates a sprocket wheel 106. Sprocket wheel 106 engages a chain 108 that is rigidly coupled at each end to a horizontally oriented strut of each end bracket 20. A pair of pulleys 110 are coupled to bracket 76 and serve both to redirect chain 108 around sprocket wheel 106 and to maintain an appropriate amount of tension in chain 108. Chain 108 passes around pulleys 110 and extends through an aperture 112 in the upper surface of bracket 76.

Figure 3:
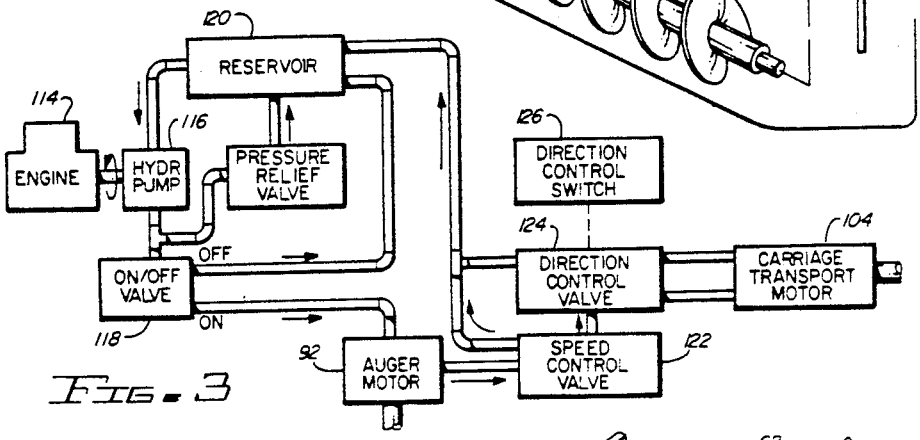
FIG. 3 is a schematic diagram representation of the hydraulic system of the concrete spreading device.

Referring now to FIGS. 1 and 3, the structure and operation of the self-contained hydraulic system for concrete spreading device 74 will be described in detail. A standard air cooled gasoline engine 114, such as an 8HP Briggs and Stratton engine, is coupled to drive hydraulic pump 116. On/off valve 118 is coupled to a front side surface of auger support bracket 82 and permits an operator of the vibratory concrete screed to either activate or deactivate auger motor 92 and carriage transport motor 104. In the "off" position, valve 118 directs hydraulic fluid from pump 116 back into an unpressurized hydraulic reservoir 120. In the "on" position, pressurized hydraulic fluid is directed from hydraulic pump 116 through auger motor 92 and speed control valve 122 to direction control valve 124. Speed control valve 122 is an automatic compensating flow control valve which regulates the volumetric flow of hydraulic fluid to carriage transport motor 104 to maintain a constant fluid flow through that motor at varying hydraulic pressures. This constant fluid flow rate maintains a constant carriage velocity as the load on gasoline engine 114 varies. A model FC-51 flow control valve manufactured by Brand Hydraulics Company of Omaha, Neb. readily accomplishes this function. A flow control lever on speed control valve 122 determines the volume of hydraulic fluid which is directed into direction control valve 124. Excess hydraulic fluid is routed by speed control valve 122 directly into hydraulic fluid reservoir 120.

Direction control valve 124 determines the direction of hydraulic fluid flow through carriage transport motor 104. Direction control valve 124 is a commercially available product manufactured by Eaton Corporation Fluid Power Operations (Minnesota Division) of Eaton Prairie, Minn. A mechanical direction control switch 126 provides the direction input signal to direction control valve 124. Direction control switch 126 is mechanically coupled to direction control valve 124.

Figure 6:
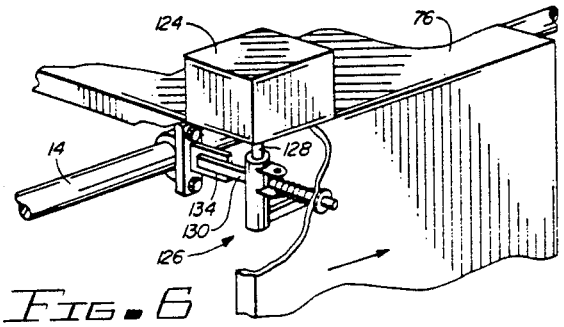
FIGS. 6–9 comprise a series of illustrations depicting the structure and operation of the carriage directional control switch.
Figure 7:
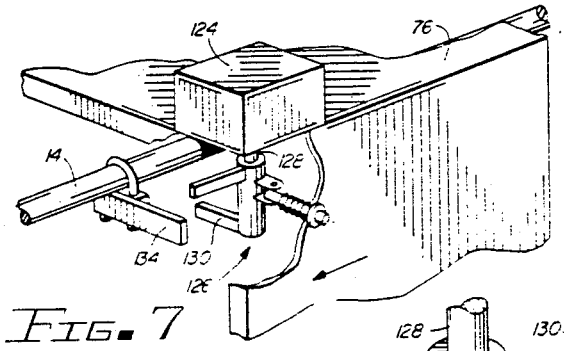
Figure 8:
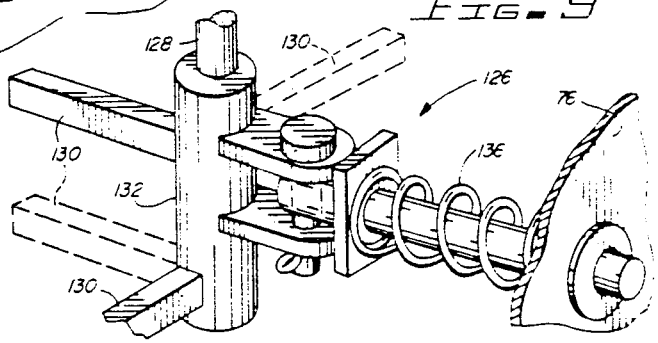

The structure and operation of direction control switch 126 will now be described in detail by referring to FIGS. 6–9. Direction control switch 126 is mechanically coupled to the actuator shaft 128 of direction control valve 124. Direction control switch 126 includes first and second horizontally oriented vertically offset sensing arms which are designated by reference number 130. These two sensing arms are coupled to a vertically oriented central support member 132 with a 90° offset. A stop bracket 134 is coupled as indicated in FIG. 7 to top pipe 14 at a selected lateral position such that the direction of travel of the concrete spreading device 74 will be changed at approximately the point where auger 84 approaches a concrete form. FIG. 6 illustrates a stop bracket 134 having different vertical offset from the stop bracket depicted in FIG. 7. This stop bracket actuates direction control switch 126 when the concrete spreading device 74 is travelling in the opposite direction.

Translation of one of the sensing arms of direction control switch 126 against stop bracket 134 causes actuator shaft 128 to be rotated 90°. This mechanical 90° rotation of direction control switch 126 actuates direction control valve 124 to reverse the flow hydraulic fluid to carriage transport motor 104. Reversal of hydraulic flow through carriage transport motor 104 causes the direction of travel of concrete spreading device 74 to be reversed. The point at which this direction reversal takes place can be adjusted by coupling stop brackets 134 at a desired location to top pipe 14.

Figure 9:
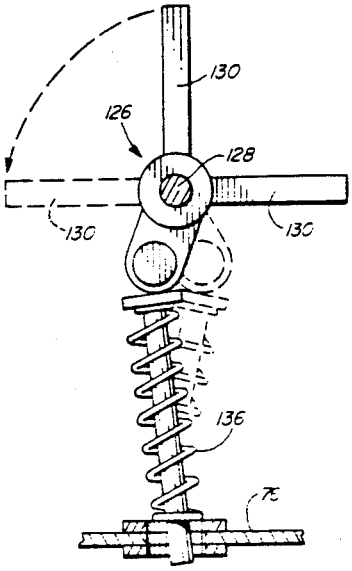

FIG. 9 best illustrates the manner in which the spring biasing structure designated by reference number 136 maintains direction control switch 126 in a predetermined fixed position once it has been actuated by a stop bracket 134.

In operation, the concrete screed of the present invention is typically translated in a forward direction into an area of unfinished concrete at a rate such that concrete spreading device 74 will pass over each section of unfinished plastic concrete two times before that section of concrete is contacted by the front screed blade assembly 16. The forward translation velocity of the screed can be adjusted in the hydraulically powered winch version by adjusting speed control valve 52. The lateral or side to side translation velocity of concrete spreading device 74 can be adjusted by speed control valve 122. A typical maximum lateral translation velocity for concrete spreading device 74 should be about 150 feet per minute.

Concrete spreading device 74 virtually eliminates the extensive manual labor which was formerly required to evenly distribute plastic concrete in front of the screed and to level the upper surface of the concrete such that the upper surface was approximately even with or slightly higher than the front screed blade assembly 16. The operation of auger 84 and the surprisingly cooperative function of grading blade 98 performs all of the preliminary concrete distributing and leveling operations previously accomplished manually with a far greater degree of precision and at a substantially faster rate resulting in significant cost savings and significantly shorter job completion times.

Figure 18:
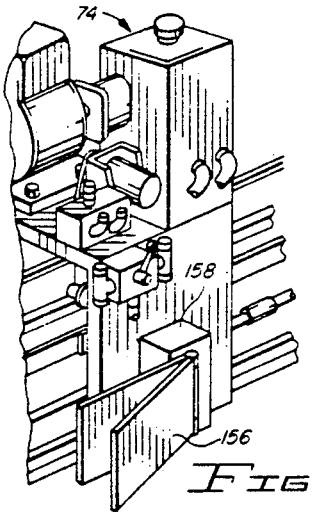
FIG. 18 is a partially cutaway perspective view depicting concrete spreading means of the present invention which includes only a "V"-shaped grading blade.
Figure 19:
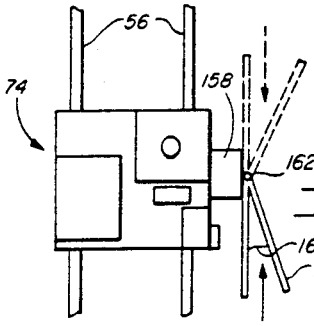
FIG. 19 is a simplified plan view of the present invention depicting concrete spreading means having a "V"-shaped grading blade, particularly illustrating the manner in which the grading blade is displaced between first and second positions as the direction of travel of the carriage changes.
Figure 20:
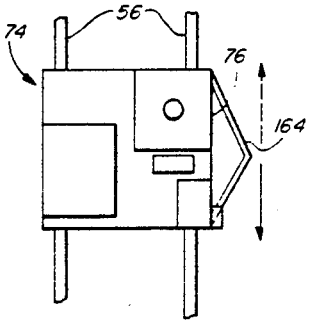
FIG. 20 is a simplified plan view of the present invention depicting a single fixed grading blade coupled to the front face of the carriage.

FIGS. 18, 19 and 20 depict mechanically simplified, less expensive versions of concrete spreading device 74. FIGS. 18 and 19 depict a configuration of the invention in which the rotating auger has been eliminated and a single, dual-face grading blade 156 is coupled by a hinge to bracket 158. In this simplified version of the present invention, the length of each grading blade is approximately eighteen inches. The angle between the two spaced apart grading blades designated by reference number 160 can be increased or decreased within a reasonable range. In the preferred embodiment of the invention, the angle designated by reference number 160 is on the order of twenty degrees. FIG. 19 depicts the manner in which grading blade 156 is deflected between first and second trailing positions with respect to hinge 162 as the direction of travel of concrete spreading device 74 is reversed.

FIG. 20 indicates yet another embodiment of the present invention in which a grading blade 164 comprises a dual-faced fixed position unit which is coupled directly to the fact of bracket 76.

The various different embodiments of the grading means of the present invention disclosed in FIGS. 18–20 and in the various other figures serve the purpose of partially insulating the many different specific hardware configurations which fall within the scope of the term "grading means." Other different types of grading means which could be coupled to a concrete spreading device having a laterally translatable carriage means for translation back and forth across the length of a concrete screed would be immediately apparent to one of ordinary skill in the art.

Figure 12:
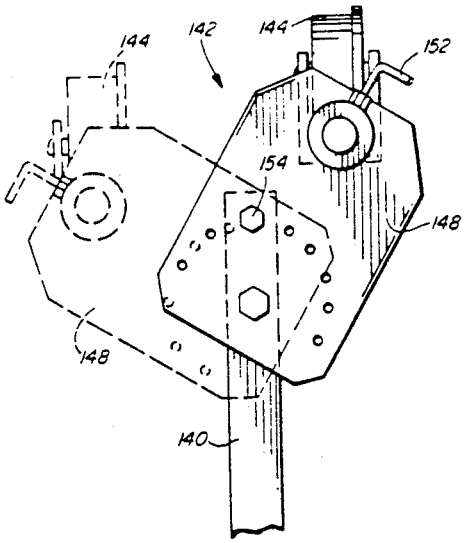
FIG. 12 is a plan view of the first and second units of the screed guide means.

Referring now to FIGS. 11 and 12, the screed guide means of the present invention will now be described in some detail. FIG. 11 illustrates that height adjustment means or jack 138 is coupled to one of the vertically oriented end members of end bracket 20. The lower end of jack 138 is coupled to a horizontally oriented roller bracket 140.

The height adjustment means described above is provided primarily for the purpose of elevating the front and rear screed blade assemblies 16 and 18 above the surface of the plastic concrete to permit the entire screed assembly to be readily translated back and forth across the concrete surface.

A separate laterally adjustable wheel unit 142 is coupled to each end of roller bracket 140. Various types of rollers 144 can be coupled to the screed guide means. In the embodiment illustrated in FIG. 11, a flanged roller 144 engages the interior edge of concrete from 146. Various different roller configurations (single flange, double flange, cupped roller, etc.) can readily be adapted to wheel unit 142 to properly interface with a form, an existing concrete edge or another screed support surface. A skid plate 147 is coupled to end bracket 20 and to front and rear screed blades 16 and 18. The flat lower surface of skid plate 147 extends the length of the screed frame and transfers the weight of the screed to form 146.

FIG. 12 best illustrates the manner in which wheel unit 142 permits roller 144 to engage a concrete form which may be positioned either inside, even with or outside of support bar 140. Since concrete screed 10 is generally fabricated from a plurality of screed sections having individual lengths of typically 2, 5 and 7½ feet, small lateral adjustments of the type provided by wheel unit 142 are important.

Each wheel unit 142 includes upper and lower, horizontally oriented pivot elements or pivot plates 148. The interior end of each pivot plate 148 includes an aperture through which a pivot pin extends to snugly couple that end of pivot plate 148 to roller bracket 140. The vertically oriented axle 150 of roller 144 can be held in a desired position by locking means such as a set screw 152 to properly align roller 144 with form 146. The lateral position of wheel unit 142 may be adjusted by removing bolt 154 and pivoting wheel unit 142 into the desired position. Bolt 154 is then inserted throgh one of the apertures which are positioned in an arc around wheel unit 142 to maintain roller 144 in a fixed lateral position.

Since a pair of wheel units 142 is coupled to each end of screed 10 and since approximately six to eight inches of lateral adjustment can be provided by each wheel unit, significant screed guide means width adjustments can be readily accomplished without having to disassemble the screed frame and either add or subtract frame sections to achieve the desired overall screed length. With very simple modifications, the screed guide means width adjustment feature discussed above could readily be modified to either provide greater or smaller amounts of lateral adjustment.

Figure 21:
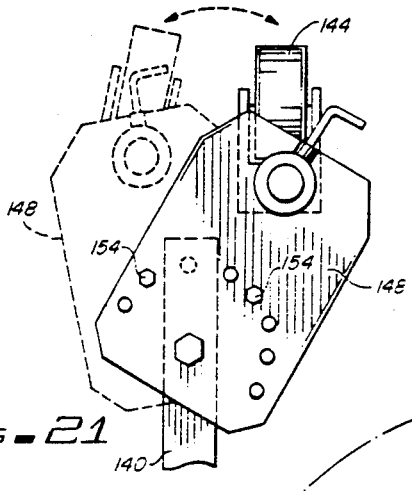
FIG. 21 depicts the manner in which a wheel unit of the screed guide means of the present invention can be configured to permit a range of movement to accommodate varying spacing between concrete forms.

FIG. 21 discloses a second configuration of the wheel unit of the present invention. In this configuration, a pair of bolts 154 are positioned through apertures in upper and lower pivot plates 148 lying outside of support bar 140. In this configuration, the wheel unit can freely pivot back and forth within a limited range determined by the position of bolts 154 to accommodate slight variations in the form spacing as the screed is advanced or rolled back along the forms.

Figure 22:
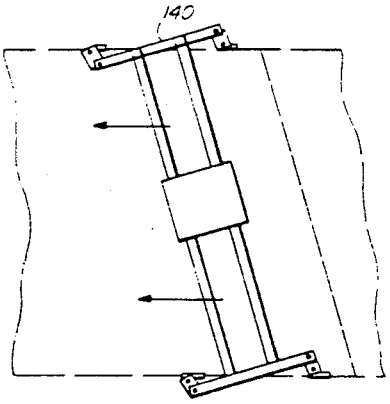
FIG. 22 illustrates the manner in which the screed guide means of the present invention can be configured to permit the screed to be skewed.

FIG. 22 indicates the manner in which the wheel units can be configured to permit the screed to operate in a skewed configuration with respect to the concrete forms. This skewed configuration is necessary when the boundaries between the freshly poured concrete and the prexisting road surface or other surface terminate or commence in a skewed configuration as frequently occurs when railroad tracks cross highways. FIG. 22 indicates that the wheel units which are coupled to support bar 140 on each end of the screed must be laterally displaced in opposite directions to permit the skewed configuration depicted.

Figure 23:
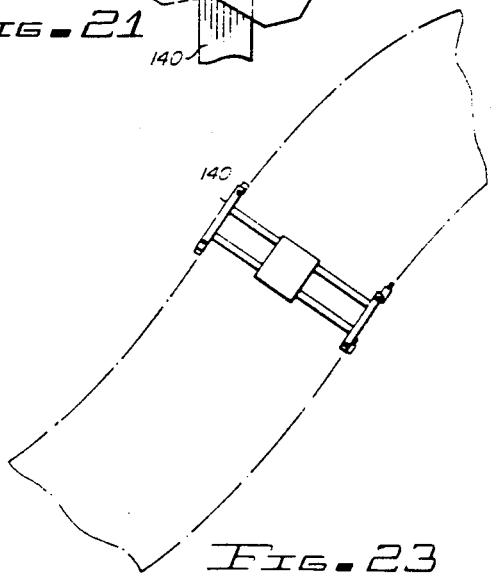
FIG. 23 is a simplified plan view of the present invention depicting the manner in which the screed guide means of the present invention permits the screed to travel along curved concrete forms.

FIG. 23 illustrates that the screed of the present invention including the screed guide means permits sufficient lateral displacement of the wheel units to enable the screed to track properly on curved forms.

Figures 24, 28:
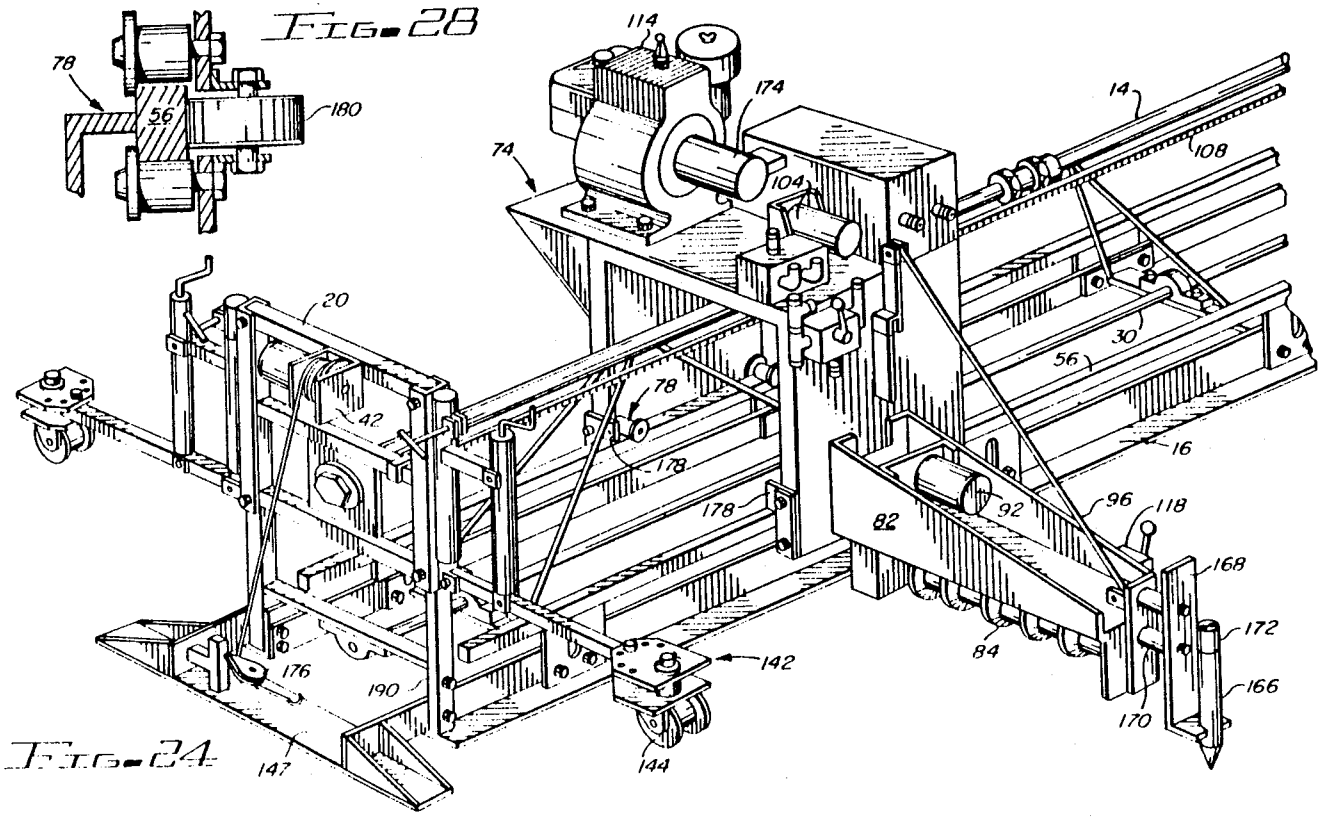
FIG. 24 is a partially cutaway perspective view of an alternative embodiment of a vibratory concrete screed including a modified concrete spreading device and a modified end support structure.
FIG. 28 is a partially cutaway sectional view of the modified roller assembly utilized on the screed depicted in FIG. 24.

Referring now to FIGS. 24–30, a modified version of the screed guide means and concrete spreading device is depicted. FIG. 24 illustrates that a vertically oriented vibrator 166 is coupled by a vertically oriented bracket and a pair of Lord vibratration isolation mounts 170 to the outer end section of auger support bracket 82. A hydraulic motor 172 is coupled to the upper section of vibrator assembly 166. The output shaft of motor 172 is coupled to rotate an eccentric weight disposed within the interior of vibrator 166. The pointed lower section of vibrator 166 penetrates the plastic concrete and imparts high frequency vibrations to the concrete for the purpose of further compacting the concrete prior to contact by auger blade 84. A pair of hydraulic lines (not shown) couple hydraulic motor 172 in parallel with auger motor 92 such that actuation of on/off valve 118 activates both auger motor 92 and vibrator motor 172.

In an alternative embodiment, vibrator 166 can be coupled to the pivoting deflector 98. Positioning vibrator 166 between the blades of deflector 98 has been found to be reasonably effective.

In the specific embodiment of the invention depicted in FIG. 24, engine 114 is coupled to drive a dual output or double hydraulic pump 174 in which each section of the pump produces a hydraulic fluid output flow on the order of four gallons per minute. One section of pump 174 powers auger motor 92 and vibrator motor 172 while the second section of pump 174 powers the carriage transport motor 104. The hydraulic circuit diagram depicted in FIG. 3 is modified in a manner well known to one of ordinary skill in the hydraulic arts to accomplish the objectives recited above in connection with the structure depicted in FIG. 24.

In the embodiment depicted in FIG. 24, a modified skid plate 147 includes front and rear sections which extend outboard of front and rear screed blades 16 and 18 to provide increased vertical stability to the screed. The winch 42 and the winch pulley 176 have been relocated as illustrated for the purpose of applying additional downward pressure to rear screed blade 18.

An "L"-shaped rubber wiper 178 is coupled by a bracket as depicted in FIG. 24 to the lower outboard edge of each corner of concrete spreading device 74. Rubber wiper 174 engages the upper and outer surfaces of horizontally oriented tracks 56 to displace splattered plastic concrete from tracks 56 and enables concrete spreading device 74 to travel smoothly back and forth across the vibrating screed.

Referring now to FIGS. 24, 28, 29 and 30, an improved version of roller assembly 78 is depicted. This embodiment includes a third, horizontally oriented roller 180 which is adjusted to snugly contact the exterior vertically oriented surface of track 56 at each of the four corners of concrete spreading device 74. FIGS. 29 and 30 depict the manner in which an eccentric adjustment device permits adjustment in the horizontal plane of the spacing between roller 180 and the vertically oriented side surfaces of concrete spreading device 74. A rotating adjustment member 182 includes an off-center cylindrical aperture. Rotation of member 182 causes the axle of roller 180 to be displaced either toward or away from track 56 to thereby adjust the pressure exerted by roller 180 on track 156.

Referring now to FIGS. 24, 25 and 26, a modified version of the screed guide means described above is depicted. In this embodiment, the screed guide means is divided into four independent sections or guide units which can each be independently adjusted in both the vertical and horizontal planes. This modified screed guide unit permits independent lateral adjustment of each roller 144 at each corner of the screed. In addition, the pressure exerted by each roller 144 on the supporting concrete form can be varied to control the vertical displacement of each of the four corners of the screed. The contact force between each end of each skid plate 147 can also be adjusted as desired. The independently adjustable screed guide means reduces or eliminated the tendency of the screed to tip forward into the plastic concrete and in addition assists in maintaining the desired contact angle between auger 84 and the plastic concrete surface.

Each independently controllable element of the improved screed guide means depicted in FIG. 24 includes a laterally pivoting hinge bracket 184. Each hinge backet 184 includes a non-rotating upper element 186 and a non-rotating lower element 188. Hinge elements 186 and 188 are each rigidly secured to a channel member 189 which is bolted to the vertical support arm 190 of end bracket 20. A smaller diameter pipe (not clearly depicted) is concentrically disposed within the interior of hinge bracket 184 and upper and lower elements 186 and 188 and serves as a hinge pin. This hinge pin pipe is secured by a bolt which extends laterally through lower element 188 and completes the structure of hinge bracket 184. Pivoting hinge element 182 surrounds and pivots freely about the hinge pin.

A hinge lock assembly 192 includes a slot 194 in the upper surface of hinge element 182, a pair of laterally extending ears and a "T"-handle 198 having a threaded shaft. FIG. 27 illustrates that right hand ear 196 includes a threaded aperture while left hand ear 196 includes a non-threaded, larger diameter aperture. Two bolts are rigidly coupled as shown to the threaded section of "T"-handle 198. Clockwise rotation of "T"-handle 198 pulls right and left ears 196 together and clamps hinge element 182 to the non-rotating concentrically mounted pipe or hinge pin. In operation, hinge element 182 is adjusted to the desired lateral position and then is locked in that position by hinge lock assembly 192.

A support bar 200 is pivotally coupled at the interior end to hinge element 182. At an intermediate point, support bar 200 is pivotally coupled to the lower end of a telescopically extendable, vertically oriented jack assembly 202. The upper portion of jack assembly 202 is pivotally coupled to a horizontally oriented support strut 204. Rotation of handle 206 of jack 202 alternately either raises or lowers support bar 200 as depicted in FIG. 25. A locking device 208 can be actuated to secure handle 206 of jack 202 in a fixed position such that vibration of the screed does not cause undesired vertical adjustment of jack 202.

Each of the four independently controllable guide units of the improved screed guide means depicted in FIG. 24 is adjusted as described above to achieve optimum performance and operation of the concrete screed.

It will be apparent to those skilled in the art that the disclosed vibratory concrete screed may be modified in numerous ways and may assume many embodiments other than the preferred form specifically set out and described above. For example, it would be readily apparent that two separate, but identical concrete spreading devices could be coupled to a single screed frame and operated in a synchronized manner such that each separate concrete spreading device was translated back and forth over only one-half the overall length of the screed. In this manner, a substantially greater area of concrete could be finished in a given time. In addition, numerous other different types of power or propulsion systems could be readily adapted to the present invention to achieve the desired results. For example, on the screed having an engine driven vibratory shaft, that same engine could power a hydraulic pump which could be coupled by overhead hydraulic lines to the concrete spreading device eliminating the hydraulic pump on that moving element of the present invention.

Figure 31A:
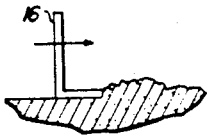
FIGS. 31A-D illustrate the excessive build-up of plastic concrete on the blade of a vibrating screed which receives an excessive charge height of plastic concrete.
Figure 31B:
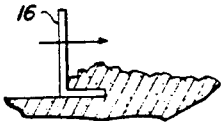
Figure 31C:
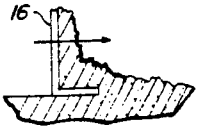
Figure 31D:
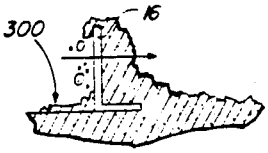
Figure 32:
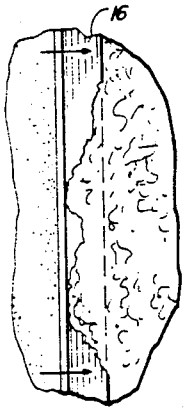
FIG. 32 (PRIOR ART)
FIG. 32 is a view from above of the blade spill-over problem illustrated in FIG. 31.

In the embodiment of the invention as illustrated in FIGS. 1 and 17, the trailing edge of auger 84 was immovably secured to carriage 76 precluding relative vertical adjustments between the trailing edge of auger 84 and front screed blade 16 disturbing the finished concrete surface designated by reference number 300 as illustrated in FIG. 31D.

Figure 33:
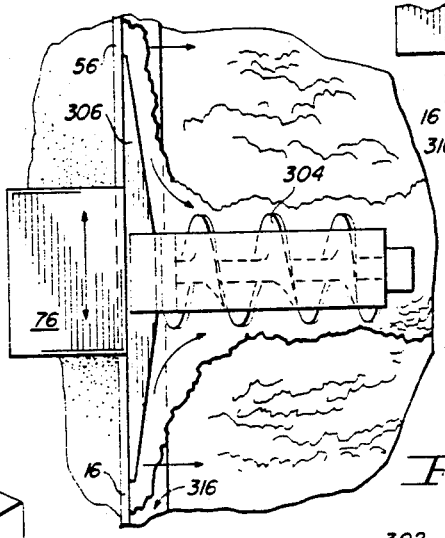
FIG. 33 is a view from above illustrating the metering means for the present invention coupled to the concrete spreading means.
Figure 34:
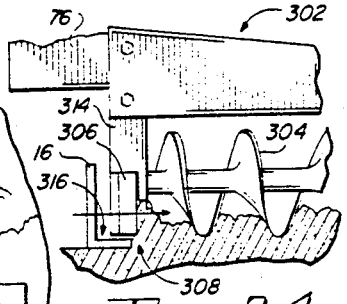
FIG. 34 illustrates the relative position of the metering means of the present invention with respect to the front screed blade and the distributing means of the present invention.
Figure 35:
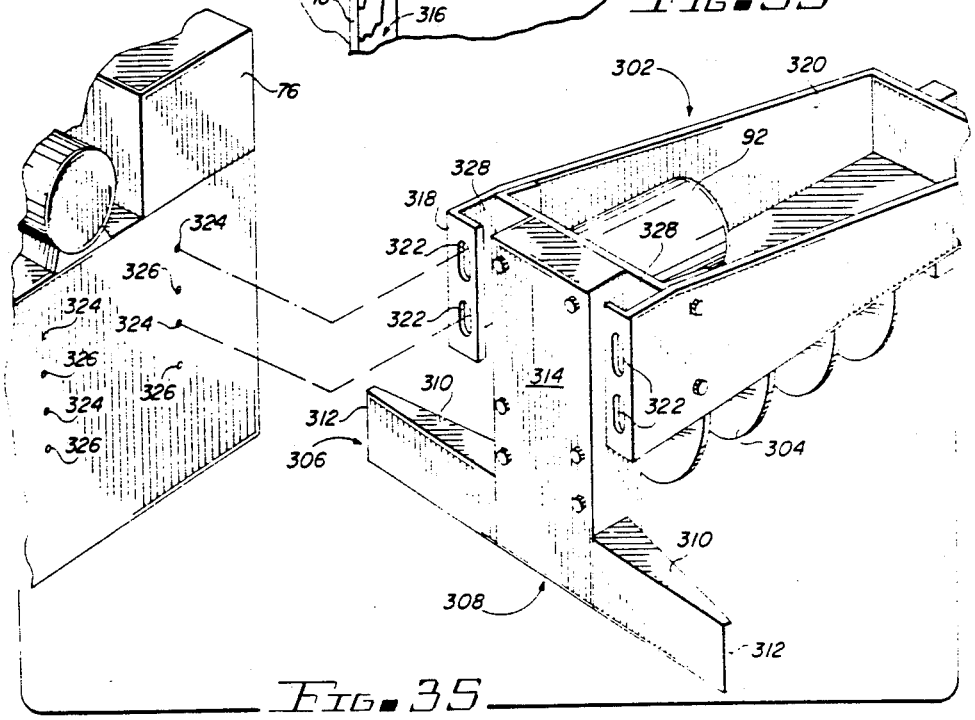
FIG. 35 depicts the grading means detached from the carriage means of the present invention to illustrate structure permitting relative vertical adjustment between the grading means and the carriage means.

In order to overcome this problem, the structure illustrated in FIGS. 33–35 has been created. The grading means 302 of the present invention has now been improved to incorporate distributing means and metering means. In the depicted preferred embodiment of the invention, the distributing means takes the form of an auger 304 and the metering means takes the form of a plow 306. Plow 306 includes a horizontally oriented, continuous lower surface 308 joining together a pair of wedge-shaped end sections 310 which each include a vertically oriented cutting edge 312. Plow 306 is coupled to the horizontally oriented lower surface of chain box 314 which houses the drive chain coupling auger drive motor 92 to auger 304.

To optimize operation of the metering means of the present invention, vertical adjustment means is provided to permit precise adjustment of the spacing between the lower surface 308 of plow 306 and the horizontally oriented surface 316 of front screed blade 16. The inner face 318 of auger support bracket 320 includes four spaced-apart, vertically oriented oval apertures 322 which may be mated with either an upper group 324 or a lower group 326 of apertures in the face of auger carriage 76. A set of four bolts (not shown) are inserted through vertically oriented channels 328, through each of the oval apertures 322 and into either the upper or lower group of apertures 324 or 326 as necessary to achieve the desired spacing between the lower surface 308 of plow 306 and the upper surface 316 of front screed blade 316. When the appropriate vertical spacing has been achieved, each of the four spaced apart mounting bolts is tightened to maintain auger support bracket 320, auger 304 and plow 306 in the desired vertical position. For example, for low slump concrete including one and one half inch stones, the spacing between the lower surface 308 of plow 306 and the upper surface 316 of blade 16 might be adjusted to approximately one and one quarter inches. For higher slump concrete, the distance between the plow and the screed blade is typically decreased. The particular plow/screed blade vertical spacing which optimizes performance of the present invention with any particular type of plastic concrete can be readily determined by persons of ordinary skill in the art.

In operation, the metering means of the present invention, including both plow 306 and the above-described vertical adjustment means, is translated back and forth along the length of the screed and as illustrated in FIGS. 33 and 34 intercepts and moves plastic concrete forward into the trailing edge of auger 304. The rotating blade of auger 304 intercepts and moves the plastic concrete forward and laterally redistributes it to produce a substantially level surface. In addition, the metering means of the present invention regulates the charge height of plastic concrete fed to the advancing screed blade 16 by stripping off and moving forward excess height plastic concrete into the trailing edge of auger 304. The elevation of the lower surface 308 of plow 306 determines the charge height of the plastic concrete fed to screed blade 16. The interrelated operation of the distributing means and metering means of the present invention feeds a partially finished, constant height charge of concrete to screed blade 16 as the carriage 76 translates the grading means of the present invention back and forth along the length of the screed frame as the screed simultaneously advances into the unfinished plastic concrete.

Figure 36:
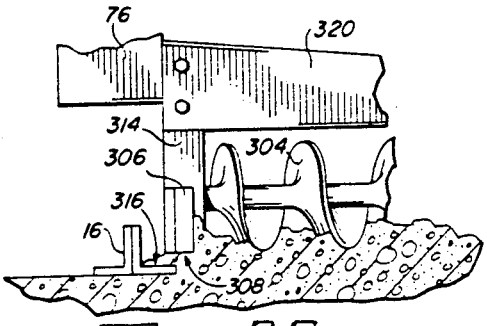
FIG. 36 illustrates the grading means of the present invention including both distributing means and metering means and its relative position with respect to a front screed blade having both forward and rear facing blade sections.
Figure 37:
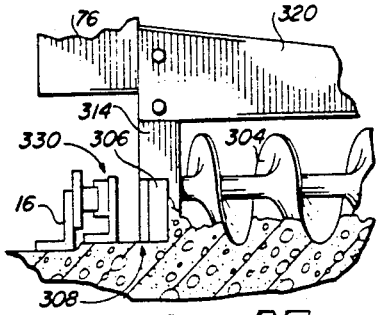
FIG. 37 illustrates the grading means of the present invention including both distributing means and metering means with an oscillating strikeoff positioned between the grading means and the screed blade.

FIG. 34 depicts the concrete spreading means of the present invention operating in connection with a single foward-facing screed blade 16. As indicated, the spacing between the lower surface 308 of plow 306 and the upper surface 316 of screed blade 16 may be made quite small. In FIG. 36, screed blade 16 includes both forward facing and rear facing L-shaped blade elements while the spacing between the lower surface 308 of plow 306 and the upper surface 316 of blade 16 has been increased to a distance slightly less than the concrete stone size. The rear edge of plow 306 is situated approximately halfway between the front and rear edges of the front L-shaped section of screed blade 16. In FIG. 37, screed blade 16 includes only a single, rear facing L-shaped blade section and an oscillating strikeoff 330 has been coupled to the screed frame between the rear surface of plow 306 and the front surface of screed blade 16. In the particular embodiment illustrated in FIG. 37, the lower blade surface of oscillating strikeoff 330 is positioned slightly above the lower surface of screed blade 16 and approximately even with the lower surface 308 of plow 306. In operation, the laterally reciprocating motion of oscillating strikeoff 330 accomplishes an intermediate consolidating and finishing operation on the partially finished plastic concrete discharged from the trailing edge of the grading means of the present invention before the plastic concrete is intercepted by screed blade 16. The differential elevation between the lower surface of oscillating strikeoff blade 330 and the lower surface of screed blade 16 may be controlled to regulate the height of the charge of plastic concrete fed to screed blade 16. In practice, the lower surface of the blade of oscillating strikeoff 330 will typically be adjusted to be even with the lower surface of screed blade 16 or as high as approximately $\frac{3}{8}$ of an inch above the lower surface of screed blade 16. Proper adjustment of the oscillating strikeoff 330/screed blade 16 height differential can be regulated by a person of ordinary skill in the art to achieve the desired concrete finishing characteristics.

Figures 38, 39, 40:
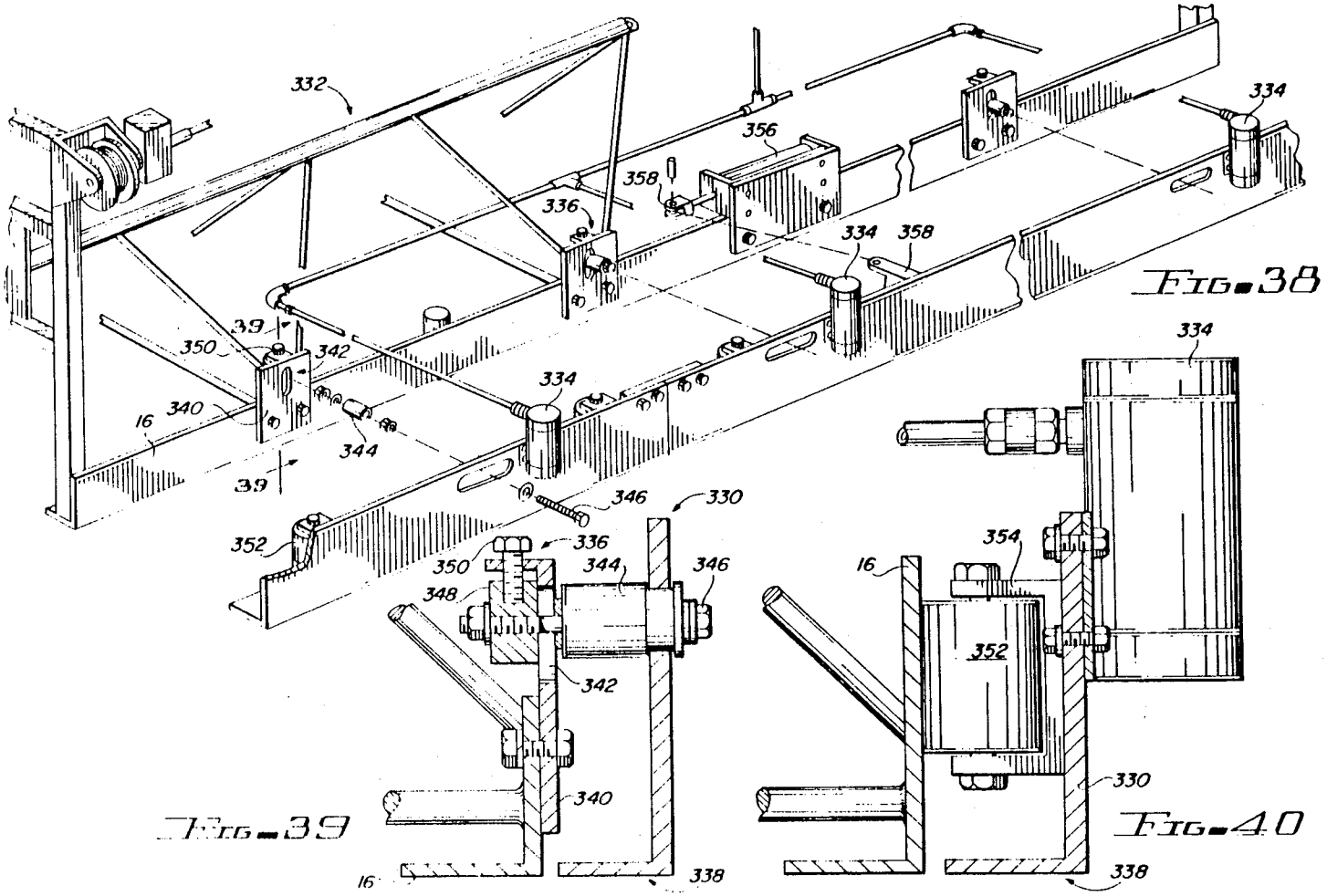
FIG. 38 illustrates the improved oscillating strikeoff including vertical strike-off blade adjustment means and a plurality of pneumatic vibrators coupled to the strike-off blade.
FIG. 39 is a sectional view of the oscillating strikeoff support structure depicted in FIG. 38, taken along section line 39—39 particularly illustrating the structure which couples the oscillating strikeoff blade to the screed.
FIG. 40 represents a sectional view of the oscillating strikeoff illustrated in FIG. 38, particularly depicting the roller structure which maintains a predetermined fixed spacing between the oscillating strikeoff blade and the screed blade.

Referring now to FIGS. 38–40, screed 332 includes an oscillating strikeoff 330 having both a plurality of pneumatically powered, high frequency air vibrators 334 as well as vertical blade adjustment means 336 for controlling the height differential between the lower surface 338 of the oscillating strikeoff 330 and the lower surface of screed blade 16. FIGS. 38 and 39 illustrate the structure of vertical blade adjustment means 336.

A plurality of vertically oriented brackets 340 are coupled to the vertically oriented face of screed blade 16 and include a centrally located, vertically oriented oval aperture 342 for accommodating vertical adjustments of oscillating strikeoff blade support units 344. A bolt 346 extends through the various elements of support unit 344 and is secured to a vertical adjustment clamp 348 which interfaces with the rear surface of bracket 340. When bolt 346 is loosened, the rotation of bolt 350 regulates the vertical position of strikeoff support unit 344 with respect to bracket 340 to control the relative elevation of the lower surface 338 of oscillating strikeoff unit 330 with respect to the lower surface of screed blade 316.

As illustrated by FIGS. 38 and 40, a plurality of spaced apart rollers 352 are coupled by brackets 354 to the interior face of the blade of oscillating strikeoff 330. The comparatively long rolling interface between rollers 352 and the vertical face of screed blade 16 maintains the blade of oscillating strikeoff 330 parallel to the vertical face of screed blade 16 as the screed is advanced into the unfinished plastic concrete.

Continuous, reciprocating motion of the oscillating strikeoff 330 is provided by reciprocating means in the form of a dual-action pneumatic ram 356 and the associated connecting linkage 358 depicted in FIG. 38. As illustrated in FIG. 4 of U.S. Pat. No. 4,466,757, oscillating strikeoff 330 may also be driven by reciprocating means in the form of hydraulic motor 64 and the associated reciprocation linkage depicted.

When the oscillating strikeoff 330 is operated without the concrete spreading means of the present invention as depicted in FIG. 38, single or dual paired air vibrators 334 may be coupled as shown to vibrate the blade of the oscillating strikeoff. When the oscillating strikeoff 330 is configured as indicated in FIG. 37 and positioned between the trailing edge of plow 306 and screed blade 16, the air vibrator 334 will typically be removed to minimze the space occupied by strikeoff 330.

Figure 41:
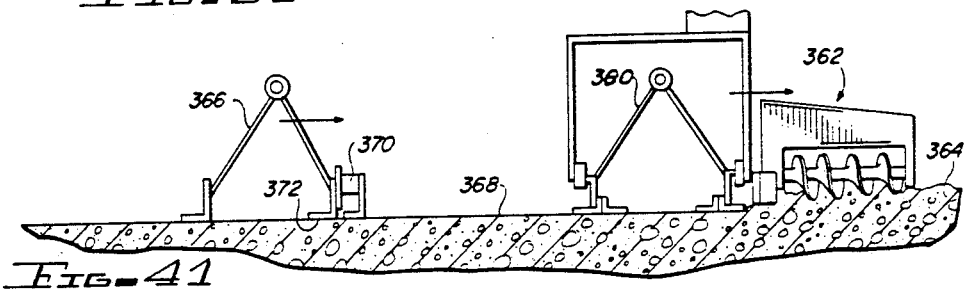
FIG. 41 depicts a paver train comprising a primary finishing screed including concrete spreading means followed in spaced apart relationship by a secondary finishing screed including an oscillating strikeoff system.
Figure 42:
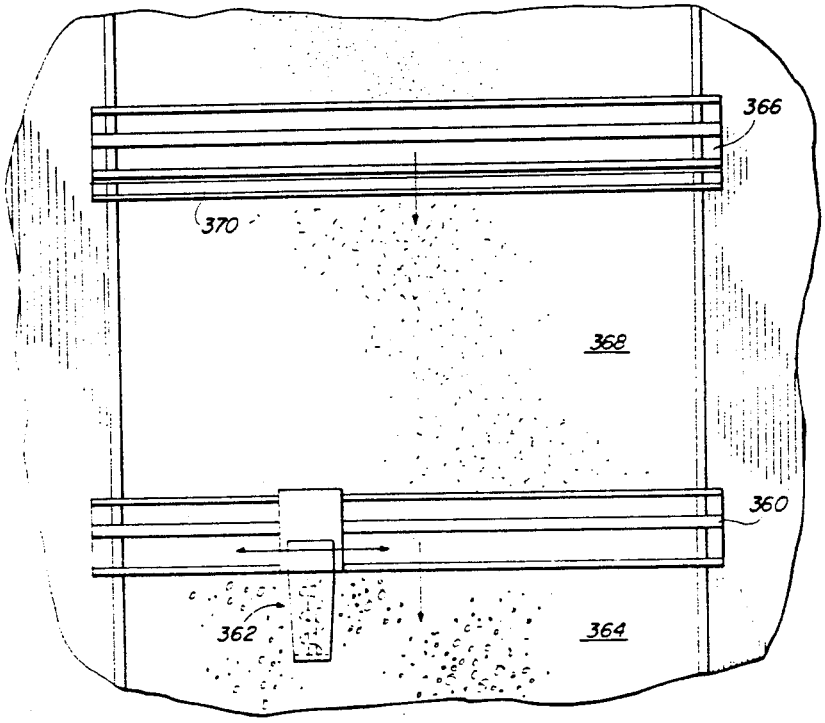
FIG. 42 represents a view from above of the paver train depicted in FIG. 41.

Referring now to FIGS. 41 and 42, a paving train consisting of a primary finishing screed 360 and a secondary finishing screed 366. Screed 360 includes concrete spreading means 362 while screed 366 includes oscillating strike-off 370. Screed 366 trails screed 360 by a predetermined time or distance to allow the partially finished concrete existing screed 360 to reach a semi-equilibrium condition prior to engagement by screed 366. Screed to screed spacing on the order of twenty to forth feet is typical although other spacing variations would be apparent to one of ordinary skill in the art.

It has been found that use of the disclosed two-unit paving train incorporating primary and secondary screeds including concrete spreading means 362 and oscillating strikeoff 370 produces a superior concrete finish. Since screeds 360 and 366 typically include precisely controllable, hydraulically actuated winches, the screed translation velocity and screed to screed spacing can easily be regulated.

It will be apparent to those skilled in the art that the disclosed vibratory concrete screed and paver train system may be modified in numerous ways and may assume many embodiments other than the preferred forms specifically set out and described above. For example, various different plow configurations other than the disclosed configuration would function effectively as metering means. Distributing means such as a V-shaped grading blade or a spinning tube finisher could be used as a substitute for the disclosed rotating auger distributing means.

Referring now to FIGS. 43–52, another version of the concrete finishing apparatus of the present invention including a laterally translatable, carriage-mounted concrete finishing device will now be discussed in detail. A supporting frame 402 includes laterally spaced apart first and second end sections 410 and 412 interconnected by a load bearing support element 414. Support element 414 may be configured in the form of a triangular truss frame having an apex or top 404, a front section extending in front of and below apex 404 and terminating in a front edge 406, and a rear section extending behind and below apex 404 and terminating in a rear edge 408. Support element 414 further includes inclined, vertically extending front and rear surfaces 416 and 418 defined by a plurality of struts which together form the triangular truss framework. A first or front concrete finishing blade 420 extends along the front edge 406 of support element 414 while a second or rear concrete finishing blade 422 extends along the rear edge 408 of support element 414. Blade 420 functions as a concrete cutting blade while blade 422 functions as a bullfloat blade.

End sections 410 and 412 each terminate in a pair of spaced apart wheel units 424 which are supported and directed by first and second laterally spaced apart guide tracks 426 which typically are configured as concrete forms. A strut extends upward from each wheel unit 424 and is coupled to a hydraulic ram 428 which enables the relative elevation of each end of end sections 410 and 412 to be varied to control the overall elevation of supporting frame 402 and concrete finishing blades 420 and 422.

An internal combustion engine 430 is supported by support element 414 and drives a double hydraulic pump 432 which generates a source of pressurized hydraulic fluid for energizing hydraulic rams 428. In the preferred embodiment of the invention, an eighteen horsepower, two cylinder Briggs & Stratton air cooled engine provides an adequate level of power to energize hydraulic pump 432. Four hydraulic valves 434 are coupled to a control panel 436 to enable an operator to control the elevation and inclination of supporting frame 402 from a single position. A combination gasoline tank/hydraulic fluid reservoir 438 is coupled to supporting frame 402 in proximity to engine 430.

Figures 43, 44, 45:
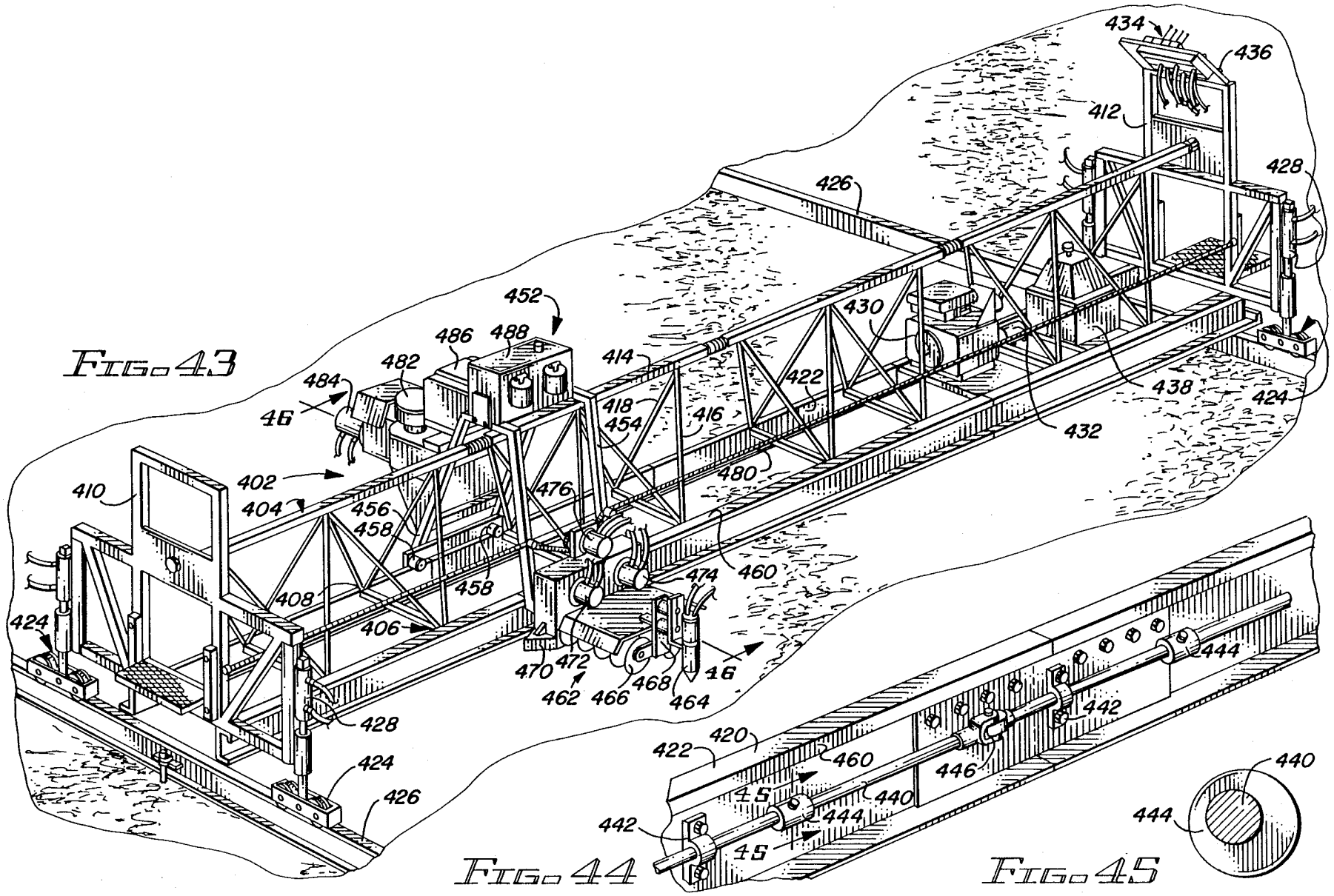
FIG. 43 is a perspective view of the concrete finishing apparatus of the present invention.
FIG. 44 is a partially cutaway perspective view of the rotating shaft plus eccentric weight vibration generating mechanism of the present invention which is coupled to the rear surface of both the front and rear screed blades for separately imparting vibratory motion of the screed blades.
FIG. 45 is a sectional view of the eccentric weight vibration generating element depicted in FIG. 44, taken along section line 45—45.

As depicted in FIGS. 43, 44 and 45, two independently controllable vibration generating systems each include a rotating shaft 440 with a plurality of spaced apart eccentric weights and a plurality of spaced apart bearings 442 which couple each system to the rearward facing surface of concrete finishing blades 420 and 422. Although not specifically illustrated in FIG. 43, each independently controllable vibration generating system is driven by an hydraulic motor, a V-belt, and a drive pulley which are mounted to end section 412. Similar structure is depicted in FIG. 11 above and designated by reference numbers 44 and 46. A separate hydraulic flow control valve is provided on operator control panel 436 to vary the operating RPM of each vibrating shaft 440 from 0–4000 RPM. The provision of separate, independently controllable vibration generating systems directly mounted on blades 420 and 422 in close proximity to the horizontally oriented blade base maximizes the transfer of vibration to the plastic concrete surface being finished by each blade and permits the amplitude and frequency of vibration imparted to each blade to be tuned for optimum concrete finishing. Typically, the vibration frequency selected for blade 420 will exceed that selected for blade 422.

In an alternative embodiment of the invention, a plurality of spaced apart pneumatic vibrators having vibrating rates on the order of eight thousand vibrations per minute can be coupled at spaced apart intervals to the rear surfaces of blades 420 and 422 to produce the desired vibratory motion of blades 420 and 422. In certain applications, it may be desireable to utilize pneumatic vibrators in combination with eccentric weight shafts to vibrate blades 420 and 422.

Figure 50:
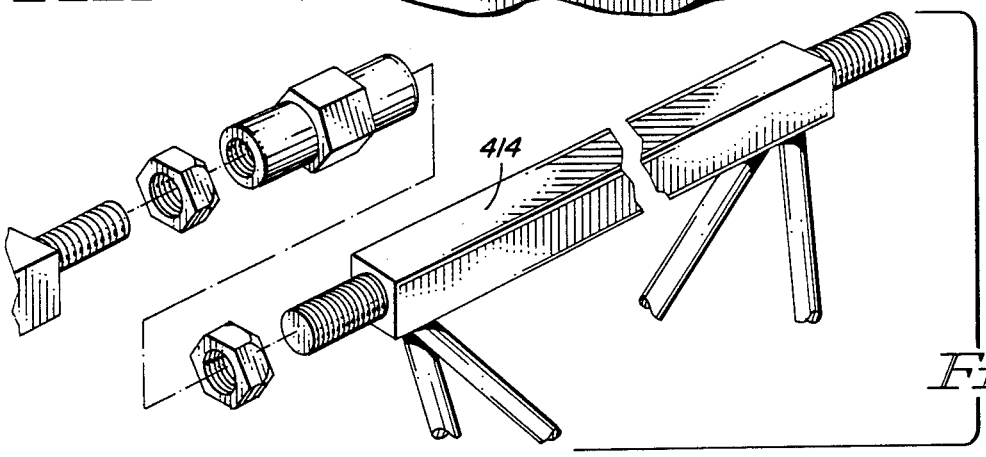
FIG. 50 is a partially cutaway perspective view of the supporting frame illustrated in FIG. 43, particularly illustrating the manner in which the supporting frame can be reconfigured to provide a crowned surface.

A universal joint coupling 446 may be inserted in shaft 440 at the mid-section of blades 420 and 422 to enable supporting frame 402 to be adjusted into a crowned configuration without causing failure of rotating shaft 440. FIG. 50 depicts the mechanical structure which provides for inclination of support element 414 to acheive finishing of crowned surfaces.

Although not specifically illustrated in FIG. 43, hydraulically powerred winch assemblies designated by reference numbers 42 and 50 in FIG. 11 may be coupled to end sections 410 and 412 with separate flow control valves located at control panel 436 to enable an operator to independently control the speed of each spaced apart winch system to thereby vary the rate of movement of the entire concrete finishing apparatus.

Figure 51:
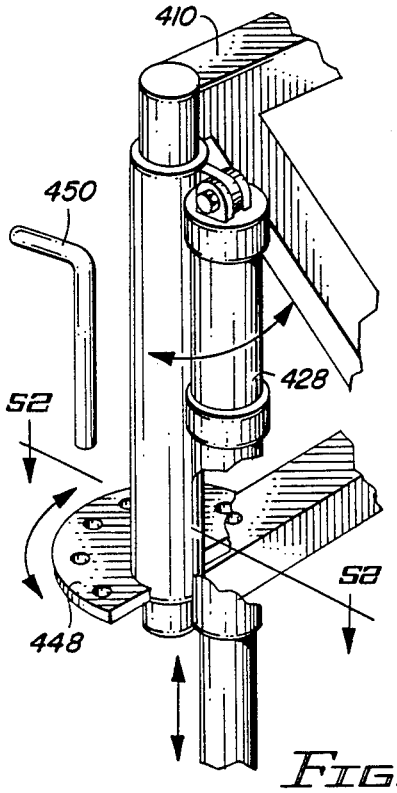
FIG. 51 is a partially cutaway perspective view of the vertical and lateral adjustment systems for the end section roller elements depicted in FIG. 43.
Figure 52:
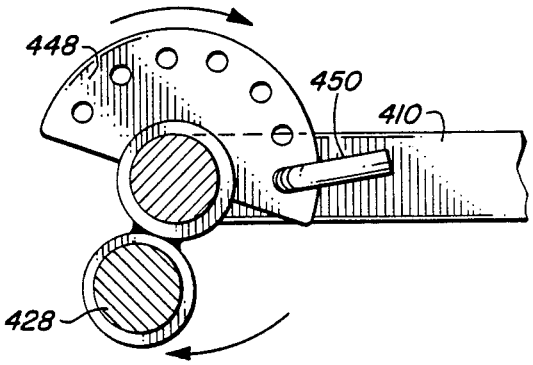
FIG. 52 is a partially cutaway view from above of the end section roller element depicted in FIG. 51, taken along section line 52—52.

Referring now to FIGS. 43, 51 and 52, a swivel bracket 448 is provided to vary the lateral position of wheel units 424 with respect to end sections 410 and 412. Once an appropriate lateral position has been selected, a locking pin 450 is inserted to maintain the selected lateral position which aligns wheel units 424 with guide tracks 426.

Figures 46, 47, 48:
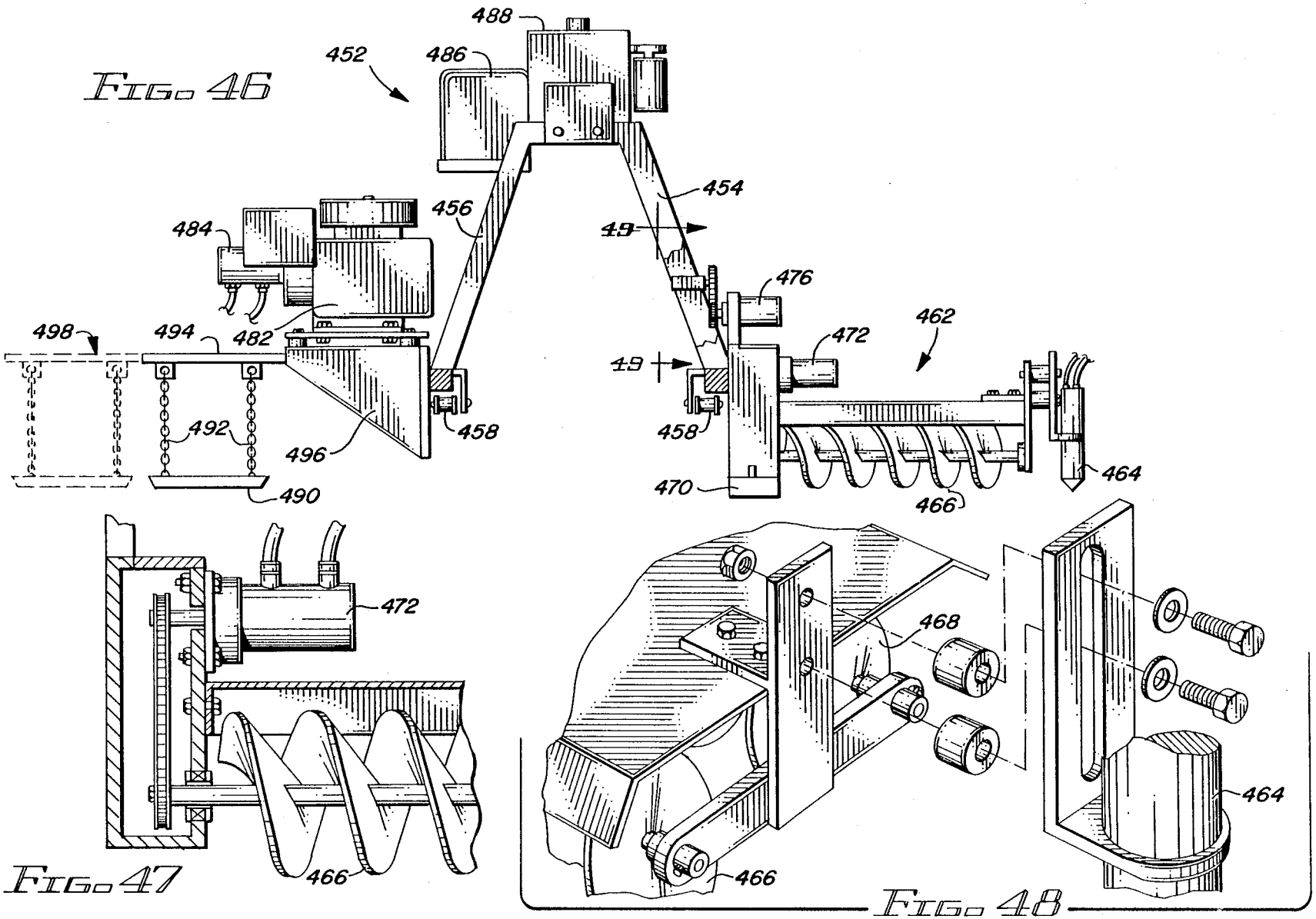
FIG. 46 is a sectional view of the carriage means of the present invention depicted in FIG. 43, taken along section line 46—46.
FIG. 47 is a partially cutaway side view of the auger and auger drive system more generally depicted in FIG. 46.
FIG. 48 is an exploded, partially cutaway perspective view of the dual auger concrete finishing means and the immersion vibrator means depicted in FIG. 46.

Referring now to FIGS. 43 and 46, carriage means 452 includes a front leg 454 and a rear leg 456 which straddle support element 414. In a manner similar to that depicted in FIGS. 17 and 28, a pair of spaced apart top rollers 458 contact the upper horizontally oriented surfaces of blades 420 and 422 to support front leg 454 and rear leg 456 of carriage means 452 on blades 420 and 422. A second pair of spaced apart bottom rollers of the type illustrated in FIGS. 17 and 28 couple legs 454 and 456 of carriage means 452 to the lower, horizontally oriented surface of blades 420 and 422. A third pair of spaced apart horizontally oriented rollers similar to roller 180 depicted in FIG. 28 operate in conjunction with the spaced apart top and bottom rollers to engage the vertically oriented outer face 460 of blades 420 and 422 to provide further coupling between carriage means 452 and blades 420 and 422.

Laterally translatable concrete finishing means 462 is coupled to and suspended from front leg 454 to carriage means 452 and includes an internal vibrator unit 464, a pair of spaced apart, counter-rotating eight inch auger blades 466 and 468 and a concrete metering means or plow 470 which assists in metering the charge height of concrete fed to concrete cutting blade 420. When viewed from the front as depicted in FIG. 43, hydraulic motor 472 rotates left auger 466 in a clockwise direction while hydraulic motor 474 rotates right auger 468 in a counterclockwise direction.

Figure 49:
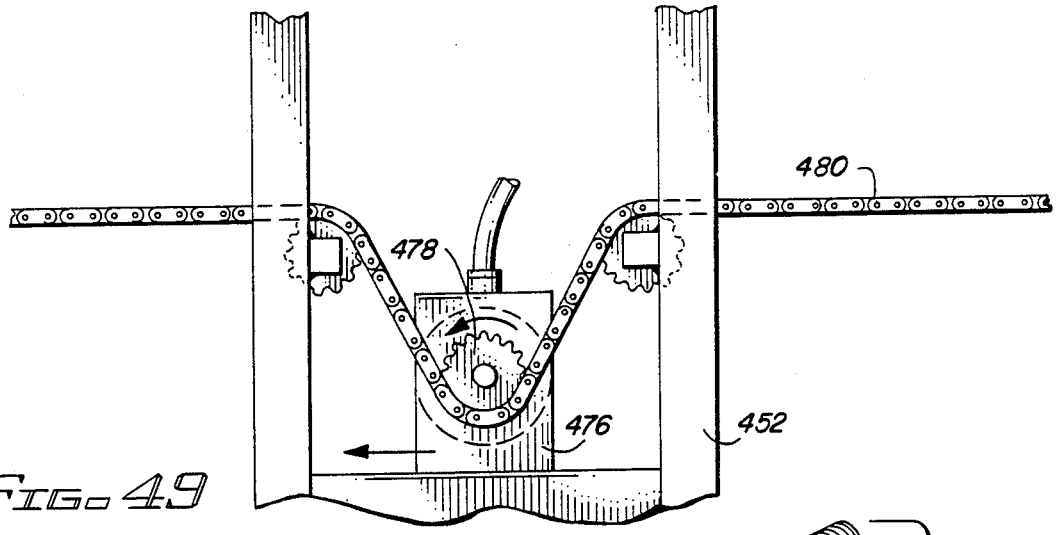
FIG. 49 is a partially cutaway elevational view of the of the hydraulic motor plus chain carriage drive means depicted in FIG. 46, taken along section line 49—49.

As depicted in FIGS. 43 and 49, a third hydraulic motor 476 on carriage means 452 includes a drive sprocket 478 which engages a horizontally oriented chain 480 enabling motor 476 to translate carriage means 452 laterally back and forth along the length of support element 414. A flow reversing valve coupled in the hydraulic circuit of motor 476 periodically engages a reversing bracket of the type depicted in FIGS. 7, 8 and 9 and reverses the direction of rotation of motor 476 as carriage means 452 approaches end sections 410 and 412 to reverse the direction of travel of carriage means 452.

An internal combustion engine 482 which in the preferred embodiment of the invention takes the form of an eighteen horsepower, two cylinder Briggs & Stratton air cooled engine is coupled to the rear leg 456 of carriage means 452 and serves as power means for energizing the various operating systems of carriage means 452. A double hydraulic pump 484 is energized by engine 482 to provide a source of pressurized hydraulic fluid for operating hydraulic motors 472, 474 and 476 as well as the hydraulically actuated, eccenric weight vibrating element positioned within internal vibrator 464.

Hydraulic flow control valves are coupled in series with hydraulic motors 472 and 474 to permit variation in the angular velocity of augers 466 and 468 which are typically rotated at a velocity of approximately 120 RPM. A separate flow control valve varies the rate of rotation of hydraulic motor 476 to vary the speed of carriage means 452 along support element 414 at rates of from 0–180 feet per minute. Motor 476 is typically adjusted to laterally translate carriage means 452 at a rate of approximately one humdred feet per minute. A master hydraulic flow cut-off switch of the type depicted in FIG. 2 and designated by reference number 118 is provided on concrete finishing means 462 to deactivate hydraulic motors 472, 474 and 476 and internal vibrator 464. A gasoline tank 486 and a hydraulic fluid reservoir 488 are coupled in the vicinity of the upper section of carriage means 452.

As illustrated in FIG. 2 and designated by reference number 96, an angularly oriented turnbuckle assembly may be provided to adjust the inclination of the shafts of augers 466 and 468 relative to the horizontal plane to adjust the effective operating height of the augers. The lateral movement of carriage means 452 in combination with the counter-rotating motion of augers 466 and 468 moves concrete toward the center of the gap between the augers and simultaneously spreads the plastic concrete laterally and forward to redistribute and level the irregular surface of freshly poured concrete, to fill voids and to maintain a comparatively constant concrete charge height at concrete cutting blade 420. Concrete charge heights on the order of three inches are preferred to minimize the occurrence of voids in the finished concrete surface. In addition, as was illustrated in FIG. 35, a plurality of oval apertures 322 or other equivalent means may be provided to adjust the relative elevation of the base of metering means 470 with respect to the horizontally oriented lower leading edge of concrete cutting blade 420 to further enhance the operation of cutting blade 420.

Rear concrete finishing blade 422 is typically configured as a mirror image of front concrete finishing blade 420 and provides a horizontally oriented rail surface for supporting the rear leg 456 of carriage means 452.

Although not specifically illustrated in FIG. 43, a plurality of hydraulic hoses serve as power transmission means for coupling the pressurized hydraulic fluid generated by double hydraulic pump 484 located on the rear leg 456 of carriage means 452 to the various hydraulically actuated components located on the front leg 454 of carriage means 452.

As best illustrated in FIG. 46, the carriage-mounted power means consisting of engine 482 and hydraulic pump 484 and the carriage-mounted concrete finishing means 462 each include a center of gravity located at an elevation below the apex 404 of the triangular truss frame of support element 414. This carriage configuration design involving spaced apart power means and concrete finishing means together with a minimum height carriage center of gravity significantly increases the stability of both the carriage means and its supporting frame in the FIG. 43 embodiment of the invention in comparison to that of the earlier embodiment of the invention depicted in FIG. 1 where the power means was secured to the upper surface of the carriage means of the invention at an elevation above the apex of the triangular truss frame.

Referring now to FIG. 46, concrete surface finishing means in the form of a pan float finisher 490 is suspended by a pair of spaced apart chains 492 from a rearward extending bracket 494. The lowermost chain segment of chains 492 engages a horizontally oriented, slotted bracket coupled to the upper surface of pan float finisher 490 which enables chains 490 to slide back and forth along the width of pan float finisher 490 in response to the direction of travel of carriage means 452 relative to support element 414. For certain applications, it may be desirable to utilize a second pan float finisher 498 as indicated by the dotted lines in FIG. 46.

Although the specific configuration of the various hydraulic elements of the carriage means hydraulic system and of the frame mounted hydraulic system have not been illustrated, the design of such a system is generally analogous to the hydraulic systems depicted in FIGS. 3 and 16. The specific configuration of the hydraulic system described above in connection with the FIG. 43 embodiment of the invention would be obvious to a person or ordinary skill in the hydraulic design art in view of the FIGS. 3 and 16 diagrams taken together with the written explanation of system operation.

It will be apparent to those skilled in the art that the disclosed laterally translatable, carriage-mounted concrete finishing apparatus may be modified in numerous ways and may assume many embodiments other than the preferred forms specifically set out and described above. For example, a variety of carriage suspension systems other than the rail and roller system depicted above could be implemented to movably support carriage means 452 on support element 414. For example, support element 414 could be fabricated with a rectangular cross section and utilize four spaced apart roller systems engaging the uppermost front and rear corners of such a support frame. The specific configuration of the invention depicted in FIG. 43 has been designed to utilize a triangular truss frame to minimize overall system weight without sacrificing necessary system structure rigidity. Such lightweight design enables the system to be supported by comparatively lightweight, standard concrete forms and to be assembled and moved about the job site without requiring heavy lift cranes. In addition, a variety of other different types of mechanisms other than the disclosed sprocket and chain drive system can function as carriage drive means to laterally translate carriage means 452 with respect to support element 414. The specific structural elements described above are intended to depict only a limited variety of preferred embodiments of the present invention without a more generalized description of a wide variety of other embodiments which would be obvious to a person of ordinary skill in the art in view of the disclosure of the present invention. Accordingly, it is intended by the appended claims to cover all such modifications of the invention which fall within the true spirit and scope of the invention.

What is claimed is:

1. Apparatus for finishing the irregular surface of an area of plastic concrete lying between first and second laterally spaced apart guide tracks, said apparatus comprising:

a. a supporting frame having first and second laterally spaced apart end sections for engaging said first and second guide tracks and for advancing said apparatus along the length of said area, said frame including a laterally oriented support element extending between said first and second end sections;

b. carriage means laterally translatable along the length of said support element and having front and rear legs straddling said support element, said carriage means including i. concrete finishing means coupled to the front leg of said carriage means for engaging and finishing the plastic concrete in front of said support element;

ii. power means coupled to the rear leg of said carriage means and interconnected with said concrete finishing means by power transmission means for energizing said concrete finishing means;

iii. carriage suspension means for movably supporting said carriage means on said support element and for enabling said carriage means to be laterally translated back and forth along the length of said support element; and iv. carriage drive means coupled to said supporting frame and to said carriage means for translating said carriage means back and forth along said support member.

2. The apparatus of claim 1 wherein the first and second end sections of said supporting frame include means for controlling the elevation and inclination of said support element with respect to the plastic concrete.

3. The apparatus of claim 1 wherein said carriage drive means further includes reversing means for sensing the position of said carriage means along the length of said support element and for reversing the direction of travel of said carriage means at a predetermined location along said support element.

4. The apparatus of claim 3 wherein said carriage drive means includes:

a. a chain positioned in front of the front surface of said support element and spanning the length of said support element; and b. a drive motor coupled to said carriage means and engaging said chain for propelling said carriage means in either first or second directions along the length of said support element.

5. The apparatus of claim 1 wherein said concrete finishing means includes a center of gravity, said power means includes a center of gravity and the center of gravity of said concrete finishing means is located below the top of said support element.

6. The apparatus of claim 5 wherein:

a. said power means includes an internal combustion engine coupled to energize a source of fluid power;

b. said concrete finishing means is energized by fluid power; and c. said power transmission means includes means for transmitting fluid power from said power means to said concrete finishing means.

7. The apparatus of claim 6 wherein said source of fluid power includes a hydraulic power source.

8. The apparatus of claim 1 wherein said support element further includes a top, a front section extending in front of and below the top, a rear section extending behind and below the top, and a first concrete finishing blade coupled to the front section of said support element for levelling and finishing the plastic concrete.

9. The apparatus of claim 8 wherein said support element further includes a second concrete finishing blade coupled to the rear section of said support element.

10. The apparatus of claim 9 wherein the upper surfaces of said first and second concrete finishing blades are configured to form rails for engaging said carriage suspension means to support and guide said carriage means as it is laterally translated along the length of said support element.

11. The apparatus of claim 3 wherein said support element includes a triangular truss having an apex defining the top of said support element and front and rear edges.

12. The apparatus of claim 11 wherein said first concrete finishing blade is coupled along the front edge of said triangular support element and wherein said second concrete finishing blade is coupled along the rear edge of said triangular support element.

13. The apparatus of claim 9 wherein said carriage means further includes concrete surface finishing means coupled to the rear leg of said carriage means for engaging and finishing the concrete surface subsequent to passage of said second concrete finishing blade.

14. The apparatus of claim 13 wherein said concrete surface finishing means includes a pan float finisher.

15. The apparatus of claim 9 further including means coupled to said supporting frame for vibrating said first and second concrete finishing blades.

16. The apparatus of claim 15 wherein said vibrating means further includes first vibrating means coupled to said first concrete finishing blade for imparting vibratory motion to said blade.

17. The apparatus of claim 16 wherein said vibrating means further includes second vibrating means coupled to said second concrete finishing blade for imparting vibratory motion to said blade.

18. The apparatus of claim 17 wherein said first and second concrete finishing blades are parallel oriented.

19. The apparatus of claim 9 wherein said concrete finishing means levels and laterally redistributes the plastic concrete as it is translated back and forth along the length of said support element.

20. The apparatus of claim 19 wherein said concrete finishing means further includes a first substantially horizontally oriented, rotating auger extending outward and away from said first concrete finishing blade.

21. The apparatus of claim 20 wherein said auger is oriented substantially perpendicular to said support element with a generally horizontal inclination.

22. The apparatus of claim 21 wherein said concrete finishing means further includes immersion vibrator means penetrating into the plastic concrete at a location in front of said auger for producing vibratory motion below the surface of the plastic concrete.

23. The apparatus of claim 21 wherein said concrete finishing means further includes metering means coupled between said auger and said first concrete finishing blade for metering the flow of concrete to said first concrete finishing blade.

24. The apparatus of claim 23 wherein said first concrete finishing means includes a base and wherein said metering means includes a plow having a base offset above the base of said first concrete finishing blade by a predetermined distance.

25. The apparatus of claim 21 wherein said first auger includes an axis of rotation and wherein said concrete finishing means further includes a second auger having an axis o auger includes an axis of rotation and wherein said concrete finishing means further includes a second auger having an axis of rotation oriented substantially parallel to the axis of rotation of said first auger.

26. The apparatus of claim 25 wherein the elevations of the axis of rotation of said first and said second augers are substantially equal.

27. The apparatus of claim 26 wherein said first auger is rotated in a direction opposite to the direction of rotation of said second auger.

28. The apparatus of claim 5 wherein the center of gravity of said power means is located below the top of said support element.

* * * * *